US011077684B2

(12) United States Patent
Kawaguchi et al.

(10) Patent No.: US 11,077,684 B2
(45) Date of Patent: Aug. 3, 2021

(54) THERMAL PRINTER

(71) Applicant: Seiko Instruments Inc., Chiba (JP)

(72) Inventors: Kouji Kawaguchi, Chiba (JP); Shinichi Sudo, Chiba (JP); Takumi Seino, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/941,773

(22) Filed: Jul. 29, 2020

(65) Prior Publication Data

US 2021/0031545 A1 Feb. 4, 2021

(30) Foreign Application Priority Data

Jul. 31, 2019 (JP) ..... JP2019-140534

(51) Int. Cl.

*B41J 15/04* (2006.01)
*B41J 2/335* (2006.01)
*B41J 11/04* (2006.01)

(52) U.S. Cl.

CPC ..... *B41J 15/042* (2013.01); *B41J 2/3355* (2013.01); *B41J 11/04* (2013.01)

(58) Field of Classification Search

CPC ..... B41J 15/042; B41J 2/3355; B41J 11/04; B41J 2202/31; B41J 2/32; B41J 11/006; B65H 41/00; B65H 2801/03

See application file for complete search history.

(56) References Cited

U.S. PATENT DOCUMENTS 7,213,968 B2 * 5/2007 Heerdt ..... G01J 5/0022 374/129
9,969,190 B2 * 5/2018 Nomura ..... B41J 11/70
2006/0171754 A1 * 8/2006 Takami ..... B41J 15/042 400/76
2009/0009517 A1 * 1/2009 Palmer ..... G06T 11/206 345/440

(Continued)

FOREIGN PATENT DOCUMENTS

EP 1527889 A1 5/2005
JP 2016-047592 A 4/2016

OTHER PUBLICATIONS

Extended European Search Report in Europe Application No. 20188865.8, dated Dec. 4, 2020, 7 pages.

*Primary Examiner* — Huan H Tran
(74) *Attorney, Agent, or Firm* — Brinks Gilson & Lione

(57) ABSTRACT

A thermal printer, includes a head unit including a thermal head configured to perform printing on a recording sheet; a platen unit, which includes a platen roller configured to convey the recording sheet, and is separably combined with the head unit; a printer main body, which has a recording-sheet receiving portion configured to receive the recording sheet, and has the head unit mounted thereto; a printer cover, which has the platen unit mounted thereto, and is coupled to the printer main body so as to be pivotable; and a separator, which is provided in the recording-sheet receiving portion, and is configured to separate parts of the recording sheet, which is rolled into a roll shape around a core body, folded on each other at a rolling start portion, which is rolled around the core body and has a turn-back shape.

10 Claims, 19 Drawing Sheets

(56) References Cited

U.S. PATENT DOCUMENTS

| | | | | |
|---|---|---|---|---|
| 2009/0028623 | A1* | 1/2009 | Yokoyama | B41J 3/4075 400/613 |
| 2016/0052307 | A1 | 2/2016 | Nomura et al. | |
| 2016/0052316 | A1* | 2/2016 | Todaka | B41J 29/38 347/188 |
| 2017/0021649 | A1 | 1/2017 | Hirose | |

* cited by examiner

*Related Art*

Related Art

THERMAL PRINTER

RELATED APPLICATIONS

This application claims priority to Japanese Patent Application No. 2019-140534, filed on Jul. 31, 2019, the entire content of which is incorporated herein by reference.

BACKGROUND OF THE INVENTION

1. Field of the Invention

The present invention relates to a thermal printer.

2. Description of the Related Art

For a printer configured to print predetermined information on a recording sheet as represented by, for example, a thermal printer, a recording sheet obtained by rolling heat-sensitive paper into a roll shape around a core body is used (see, for example, Patent Literature 1).

In a related-art thermal printer, when the thermal printer is driven under a state in which the recording sheet is absent, there is a risk of causing a defect such as thermal destruction of a heat-generating element (thermal head). In order to prevent such driving without the recording sheet, typically, a recording-sheet sensor configured to detect presence or absence of the recording sheet is provided at a position on an upstream side of the heat-generating element. Further, at the position of the recording-sheet sensor on a path of the recording sheet, in order to more reliably detect the presence or absence of the recording sheet, a gap is regulated to be narrow in a thickness direction of the recording sheet.

Here, for the reason of manufacturing, as illustrated in FIG. 17A, it is sometimes required that the recording sheet rolled into the roll shape be formed such that a leading edge 100*a* of a recording sheet 100 is formed into a turn-back shape of turning back in a direction opposite to a rolling direction at a rolling start portion 102 of the recording sheet 100, which is a portion of starting rolling around a shaft portion (core; core body). However, as illustrated in FIG. 17B and FIG. 17C, in the case in which the rolling start portion 102 of the recording sheet 100 is formed into the turn-back shape, when the rolling start portion 102 is conveyed into the narrow gap while keeping the turn-back shape, a paper jam may occur to cause, for example, step out of a driving motor or tooth skipping of a gear. As a result, there is a fear in that a driving force is not transmitted to the recording sheet 100, and sheet feeding cannot be performed. In such a case, the recording sheet 100 stays around the sensor on the path of the recording sheet 100. Accordingly, a detection signal of the sensor remains in a state of indicating the presence of the recording sheet, and printing processing with use of the heat-generating element is continued. Meanwhile, the sheet feeding cannot be performed, and hence a receipt or the like cannot be issued. In particular, occurrence of the circumstance described above in an automatic teller machine (ATM) or an unmanned terminal provided in a kiosk may cause serious problems in terms of both business and trust. Further, when such a state continues for a long period of time, the printing processing with the use of the heat-generating element is performed at the same position on the recording sheet 100. As a result, heat stays in the heat-generating element, which may cause defects such as thermal destruction of the heat-generating element and poor printing due to an increase in resistance value.

In view of the problems described above, there has been a demand for a reliable thermal printer, which is capable of reliably separating parts of the recording sheet folded on each other and preventing a paper jam or the like even in a case in which the rolling start portion of the recording sheet rolled into the roll shape has the turn-back shape.

SUMMARY OF THE INVENTION

According to one embodiment of the present invention, there is provided a thermal printer, including a head unit including a thermal head configured to perform printing on a recording sheet; a platen unit, which includes a platen roller configured to convey the recording sheet, and is separably combined with the head unit; a printer main body, which has a recording-sheet receiving portion configured to receive the recording sheet, and has the head unit mounted thereto; a printer cover, which has the platen unit mounted thereto, and is coupled to the printer main body so as to be pivotable; and a separator, which is provided in the recording-sheet receiving portion, and is configured to separate parts of the recording sheet, which is rolled into a roll shape around a core body, folded on each other at a rolling start portion, which is rolled around the core body and has a turn-back shape.

In the above-mentioned thermal printer according to the one embodiment of the present invention, wherein the separator includes a first separation wall which is provided at a position at which, when the rolling start portion of the recording sheet is unrolled, at least a part of a peripheral surface of the rolling start portion is brought into abutment along with a repulsive force generated by the stiffness of the recording sheet.

In the above-mentioned thermal printer according to the one embodiment of the present invention, wherein the first separation wall is provided so as to pressurize at least a part of the peripheral surface of the rolling start portion of the recording sheet.

In the above-mentioned thermal printer according to the one embodiment of the present invention, wherein the first separation wall includes a frictional-resistance member at a position at which at least a part of a peripheral surface of the rolling start portion of the recording sheet is brought into abutment.

In the above-mentioned thermal printer according to the one embodiment of the present invention, wherein the first separation wall includes a locking portion configured to lock an end portion formed into a turn-back shape at the rolling start portion at a position at which at least a part of a peripheral surface of the rolling start portion of the recording sheet is brought into abutment.

In the above-mentioned thermal printer according to the one embodiment of the present invention, wherein the first separation wall is mounted to the printer cover.

In the above-mentioned thermal printer according to the one embodiment of the present invention, wherein the separator further includes a second separation wall which is provided at a position of being opposed to the first separation wall across the unrolled recording sheet and at which at least a part of the peripheral surface of the rolling start portion is brought into abutment along with a repulsive force generated by the stiffness of the recording sheet when the rolling start portion of the recording sheet is unrolled.

In the above-mentioned thermal printer according to the one embodiment of the present invention, wherein the second separation wall includes a frictional-resistance member at a position at which at least a part of a peripheral surface of the rolling start portion of the recording sheet is brought into abutment.

In the above-mentioned thermal printer according to the one embodiment of the present invention, wherein the second separation wall includes a locking portion configured to lock an end portion formed into a turn-back shape at the rolling start portion at a position at which at least a part of a peripheral surface of the rolling start portion of the recording sheet is brought into abutment.

In the above-mentioned thermal printer according to the one embodiment of the present invention, wherein the second separation wall is mounted to the printer main body.

In the above-mentioned thermal printer according to the one embodiment of the present invention, wherein In the above-mentioned thermal printer according to the one embodiment of the present invention, wherein the separator further includes a guide portion, which is located at a position of being opposed to the second separation wall across the unrolled recording sheet in the platen unit and in the vicinity of an inlet of a gap portion to which the recording sheet is conveyed, and is configured to guide the recording sheet.

In the above-mentioned thermal printer according to the one embodiment of the present invention, wherein In the above-mentioned thermal printer according to the one embodiment of the present invention, wherein the guide portion is formed of a guide shaft which is in parallel with the core body of the recording sheet and is pivotable.

In the above-mentioned thermal printer according to the one embodiment of the present invention, wherein the guide portion is formed of a guide wall which projects so as to be opposed to the second separation wall.

In the above-mentioned thermal printer according to the one embodiment of the present invention, wherein the separator further includes a tension bar, which is located at a position of being opposed to the first separation wall across the unrolled recording sheet, and is configured to guide the recording sheet toward the first separation wall side.

In the above-mentioned thermal printer according to the one embodiment of the present invention, wherein the thermal printer further includes a locking portion, which is provided on at least a part of a surface of the tension bar, and is configured to lock an end portion of the recording sheet at the rolling start portion formed into the turn-back shape.

In the above-mentioned thermal printer according to the one embodiment of the present invention, wherein the separator includes a tension bar, which is provided at a position of being opposed to the platen unit across the unrolled recording sheet, and is configured to guide the recording sheet toward the platen unit side; a guide portion, which is provided so as to be opposed to the tension bar at a position in the vicinity of an inlet of a gap portion to which the recording sheet is conveyed in the platen unit, and against which the recording sheet guided toward the platen unit side by the tension bar is brought into abutment; and a third separation wall, which is provided on a side opposite to the guide portion across the guide portion in the vicinity of an inlet of the gap portion, and against which at least a part of the recording sheet guided by the tension bar and the guide portion is brought into abutment, wherein a distal end of the tension bar and a distal end of the guide portion are arranged so as to overlap each other in a direction in which the platen unit and the tension bar are opposed to each other.

In the above-mentioned thermal printer according to the one embodiment of the present invention, wherein the third separation wall includes a locking portion configured to lock an end portion formed into a turn-back shape at the rolling start portion at a position at which at least a part of a peripheral surface of the rolling start portion of the recording sheet is brought into abutment.

In the above-mentioned thermal printer according to the one embodiment of the present invention, wherein the separator includes a tension bar configured to guide the recording sheet toward the platen unit side at a position of being opposed to the platen unit across the unrolled recording sheet; a fourth separation wall, which is arranged between the platen unit and the tension bar, and is configured to guide the recording sheet between the fourth separation wall and the tension bar; and a third separation wall, which is provided in the vicinity of an inlet of the gap portion, and against which at least a part of the recording sheet guided by the tension bar and the fourth separation wall is brought into abutment.

In the above-mentioned thermal printer according to the one embodiment of the present invention, wherein the fourth separation wall is mounted to the printer cover.

In the above-mentioned thermal printer according to the one embodiment of the present invention, wherein the separator is formed of a pair of guide rolls which are provided so as to pressurize the recording sheet so that at least a part of the recording sheet is brought into abutment against a frictional-resistance member when the rolling start portion of the recording sheet is unrolled.

BRIEF DESCRIPTION OF THE DRAWINGS

FIG. 15A.

DETAILED DESCRIPTION OF THE PREFERRED EMBODIMENTS

Figure 1:
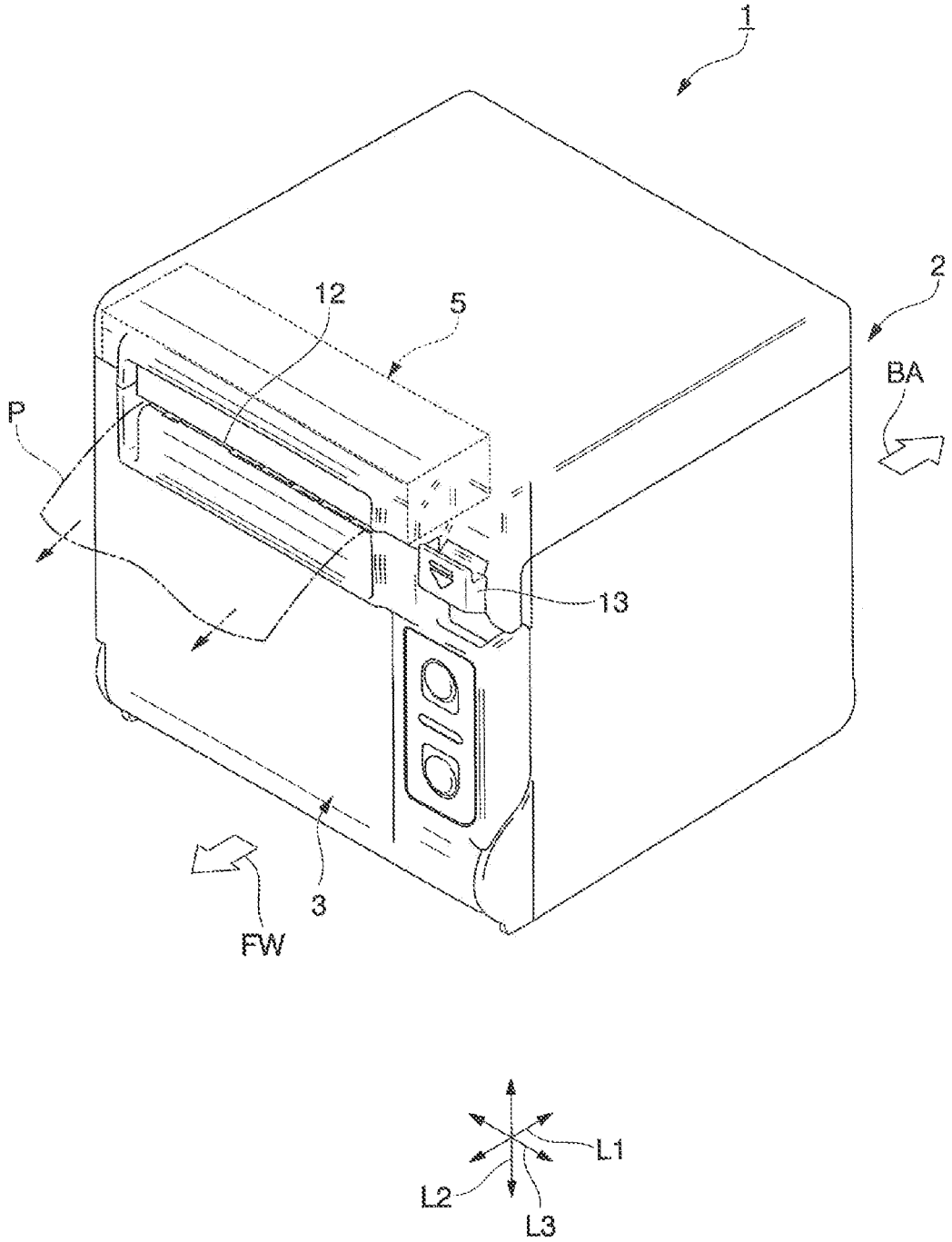
FIG. 1 is a view for schematically illustrating a thermal printer according to a first embodiment of the present invention, and is a perspective view for illustrating a state in which a printer cover is closed.

Now, embodiments of a thermal printer of the present invention are given, and configurations thereof are described in detail with reference to FIG. 1 to FIG. 16C. In the drawings to be used in the following description, for convenience of easily understanding features of the thermal printer of the present invention, characteristic portions are enlarged in some cases, and may be different, for example, in dimensions and ratios of elements from those of actual products in some cases. Further, materials, dimensions, and the like to be exemplified in the following description are examples. The present invention is not limited to those examples, and can be practiced with suitable modifications within the range of not modifying the gist of the present invention.

First Embodiment

In the following, a first embodiment of the present invention is described in detail with reference to FIG. 1 to FIG. 7.

Figure 2:
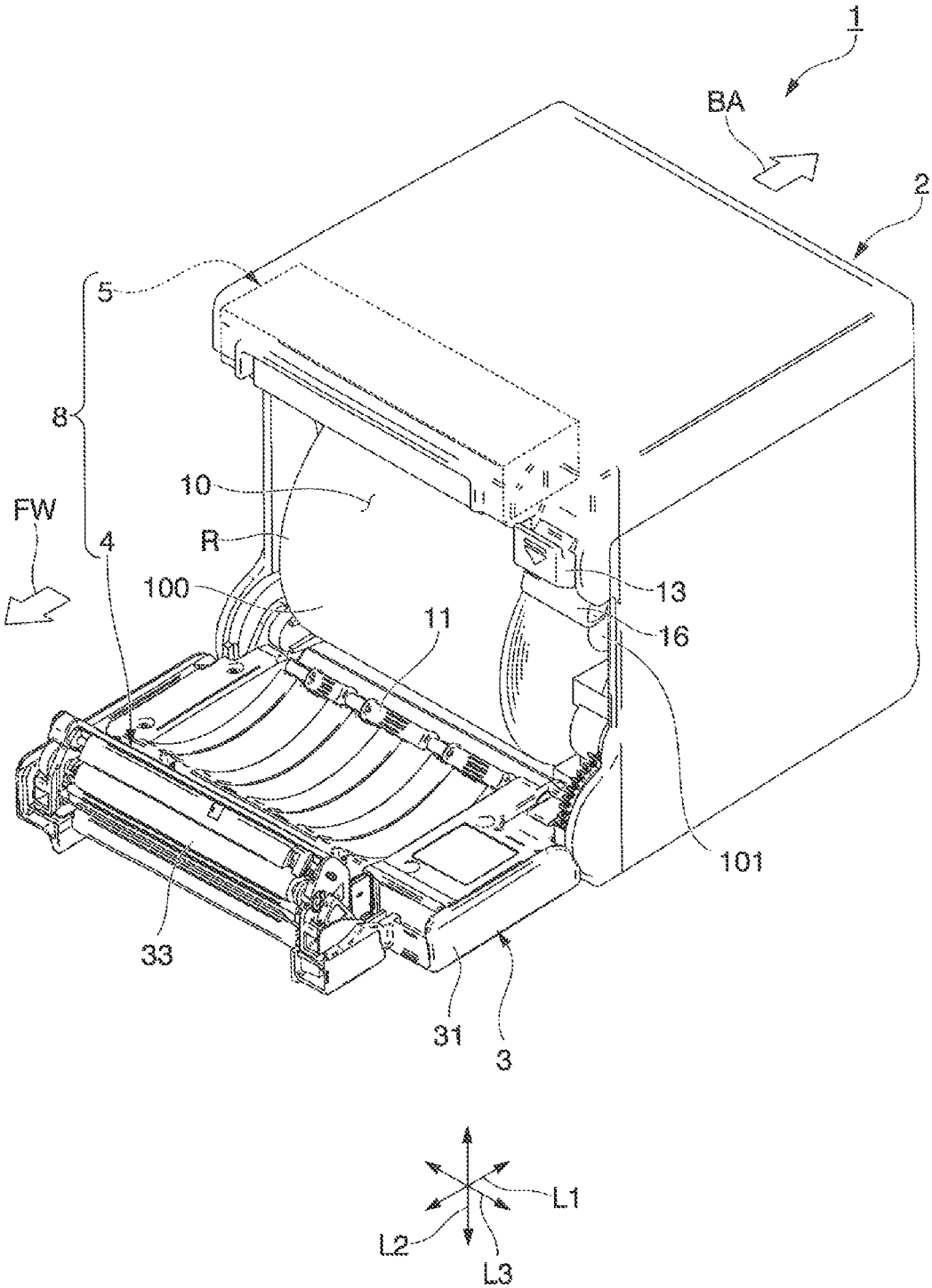
FIG. 2 is a view for schematically illustrating the thermal printer according to the first embodiment of the present invention, and is a perspective view for illustrating a state in which the printer cover is opened in the thermal printer illustrated in FIG. 1.
Figure 3:
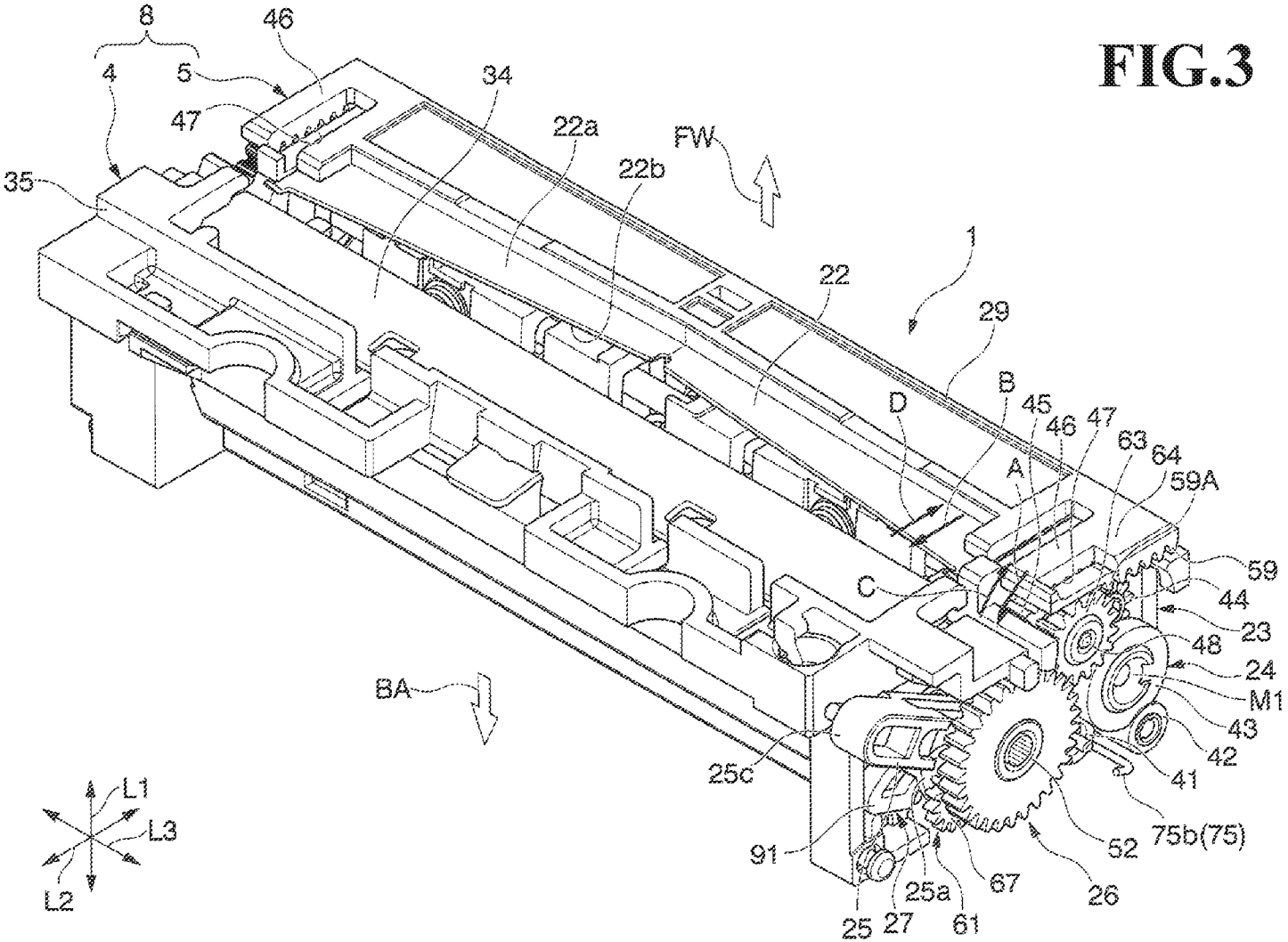
FIG. 3 is a view for schematically illustrating the thermal printer according to the first embodiment of the present invention, and is a perspective view for illustrating a head unit and a platen unit provided to the thermal printer illustrated in FIG. 1 and FIG. 2.

Now, a configuration of a thermal printer according to this embodiment is described. FIG. 1 is a perspective view for illustrating a thermal printer 1 according to this embodiment in a state in which a printer cover 3 is closed. FIG. 2 is a perspective view for illustrating a state in which the printer cover 3 is opened. FIG. 3 is a perspective view for illustrating a head unit 5 and a platen unit 4 provided to the thermal printer 1 according to this embodiment.

As illustrated in FIG. 1 and FIG. 2, the thermal printer 1 according to this embodiment is a small-sized thermal printer that is to be used for printing tickets of various types, for example, at an ATM or an unmanned terminal provided in a kiosk or at a convenience store. That is, the thermal printer 1 is a printer (terminal) which is configured to perform thermal printing on a recording sheet (for example, heat-sensitive paper) 100 pulled out from a roll sheet R so that the recording sheet 100 can be used as, for example, a ticket or a receipt.

The thermal printer 1 includes a casing (printer main body) 2, the printer cover 3, the platen unit 4 provided on the printer cover 3 side, and the head unit 5 provided on the casing 2 side. Further, in this embodiment, the platen unit 4 and the head unit 5 form a printing unit 8.

In this embodiment, at the closed position of the printer cover 3 illustrated in FIG. 1, a lower left side (printer cover 3 side) of a drawing sheet is defined as a forward side (direction of the arrow FW), an upper right side (casing 2 side) thereof is defined as a backward side (direction of the arrow BA), an upper side thereof is defined as an upward side, and a lower side thereof is defined as a downward side. Further, a recording sheet P is delivered to the forward side FW. A direction orthogonal to a front-and-back direction L1 and an up-and-down direction L2 is defined as a right-and-left direction L3. Further, in each of other drawings, when the thermal printer 1 is illustrated with changes in directions, the symbols indicating the directions are described in the drawings.

Description is made more in detail. The thermal printer 1 according to this embodiment includes the printing unit 8 which is formed of the head unit 5 and the platen unit 4. The head unit 5 includes a thermal head (not shown) configured to perform printing on the recording sheet 100. The platen unit 4 includes a platen roller 33 configured to convey the recording sheet, and is separably combined with the head unit 5. Further, the thermal printer 1 has a recording-sheet receiving portion 10 configured to receive the recording sheet 100, and mainly includes the casing 2 and the printer cover 3. The casing 2 has the head unit 5 mounted thereto. The printer cover 3 has the platen unit 4 mounted thereto, and is coupled to the casing 2 so as to be pivotable.

Figure 4A:
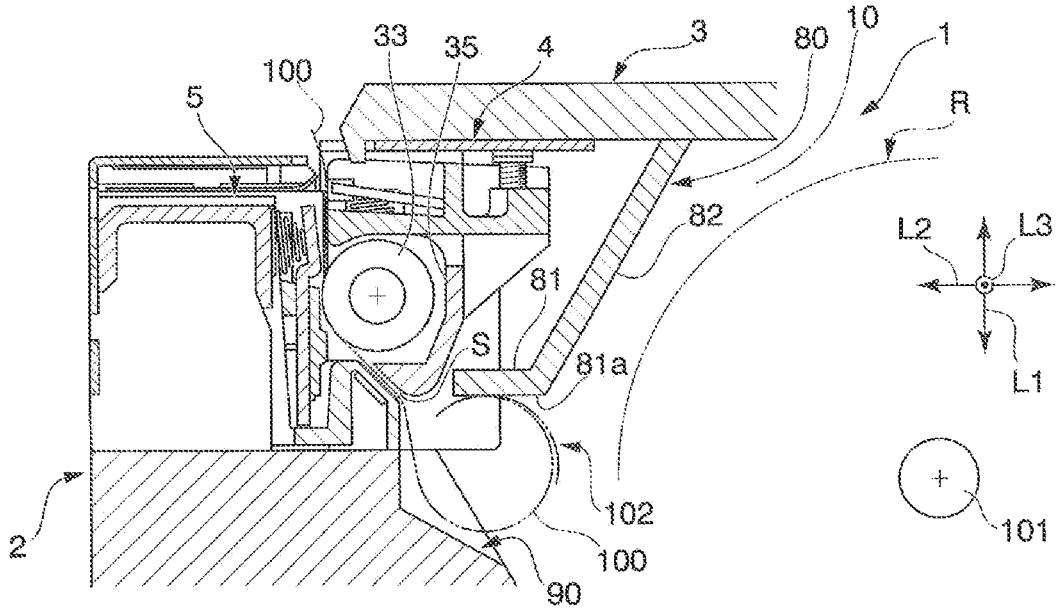
FIG. 4A is a view for schematically illustrating a main part of the thermal printer according to the first embodiment of the present invention, and is a partial cutaway view for illustrating a relationship of a first separation wall provided to a recording-sheet receiving portion with respect to a rolling start portion of a recording sheet formed into a turn-back shape.
Figure 4B:
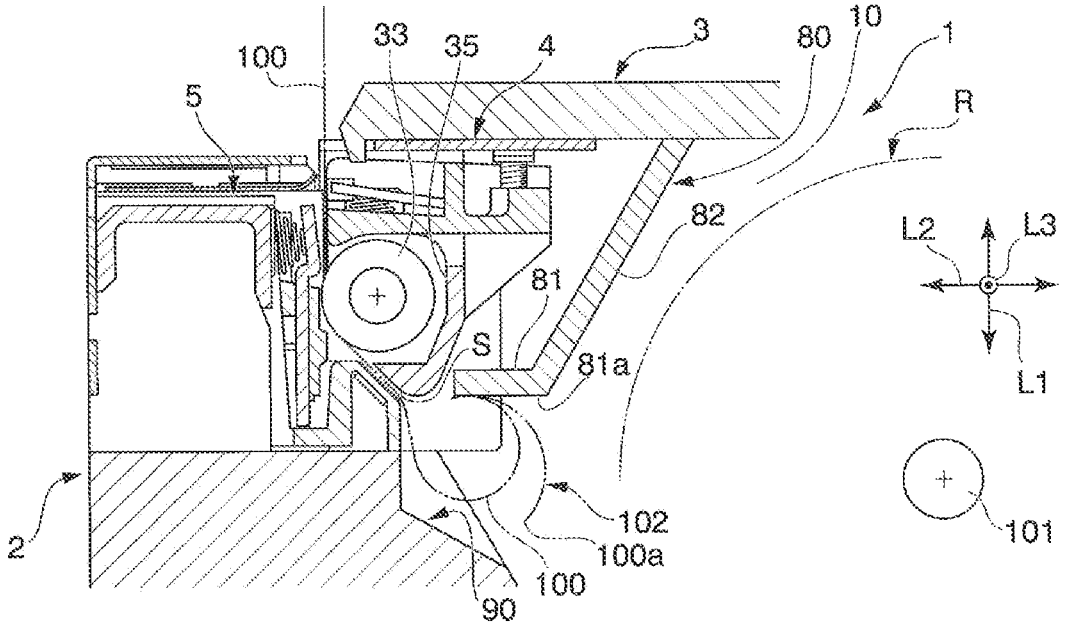
FIG. 4B is a view for schematically illustrating the main part of the thermal printer according to the first embodiment of the present invention, and is a partial cutaway view for illustrating a relationship of the first separation wall provided to the recording-sheet receiving portion with respect to the rolling start portion of the recording sheet formed into the turn-back shape.
Figure 4C:
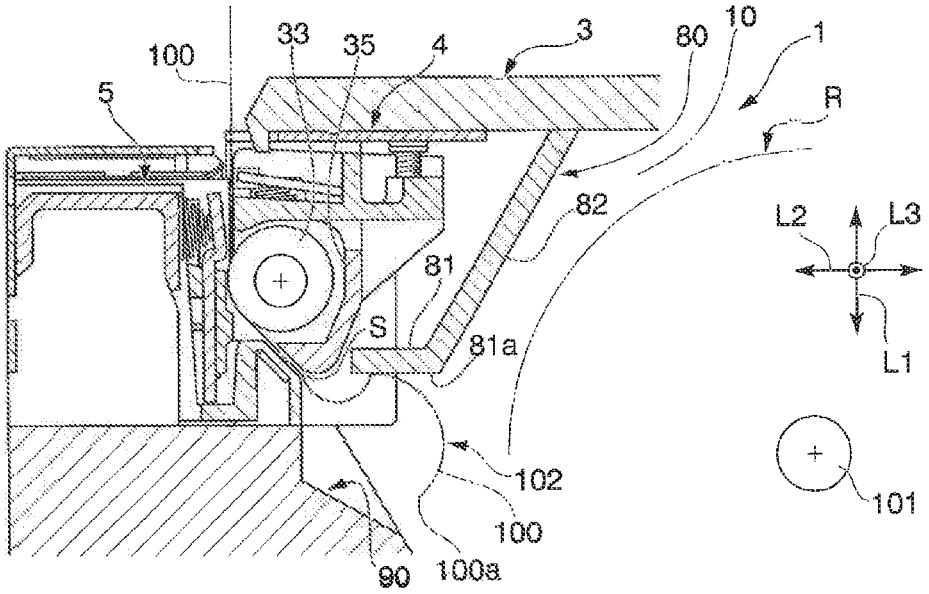
FIG. 4C is a view for schematically illustrating the main part of the thermal printer according to the first embodiment of the present invention, and is a partial cutaway view for illustrating a relationship of the first separation wall provided to the recording-sheet receiving portion with respect to the rolling start portion of the recording sheet formed into the turn-back shape.
Figure 5:
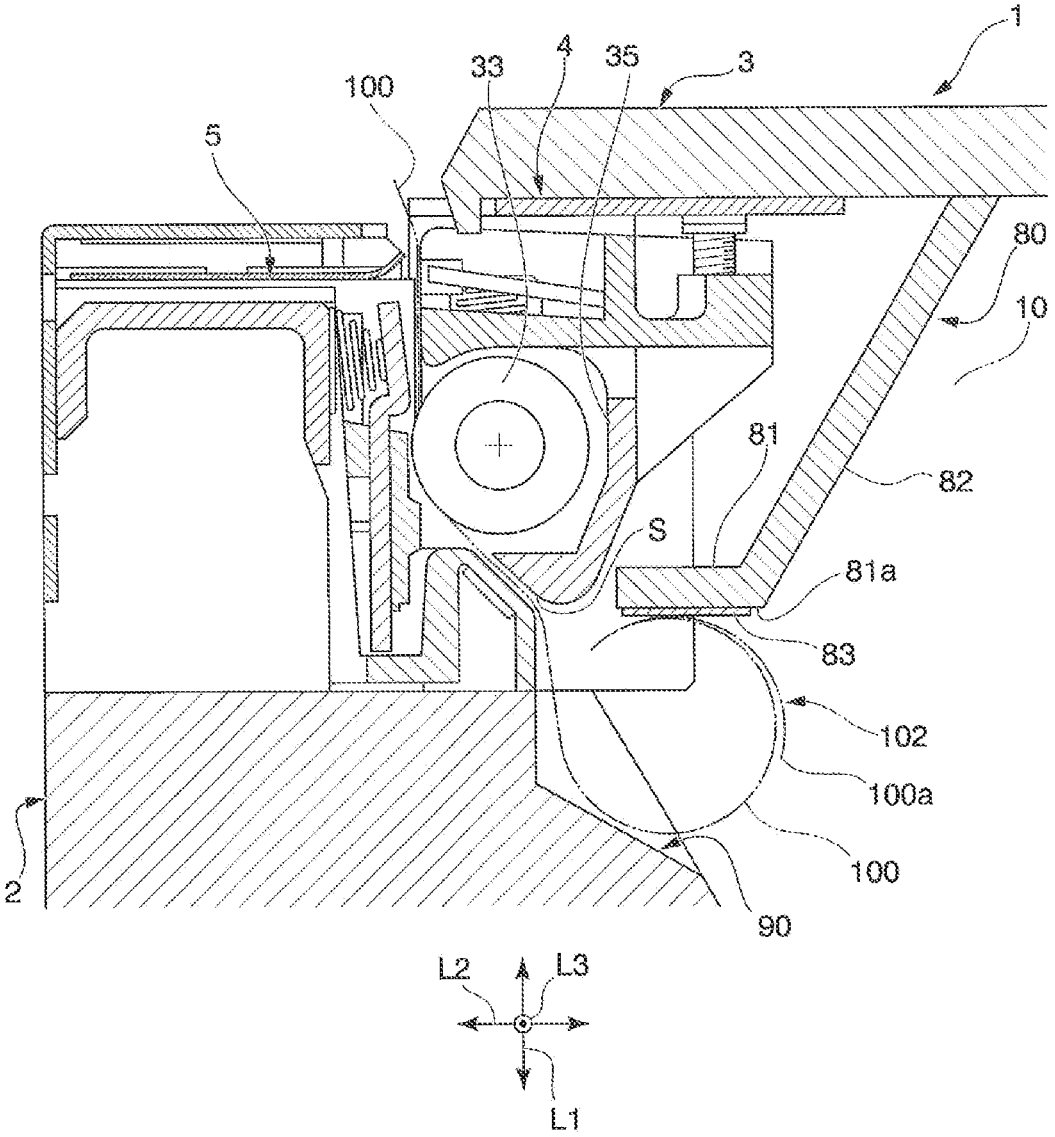
FIG. 5 is a view for schematically illustrating the thermal printer according to the first embodiment of the present invention, is a view for illustrating a modification example of the thermal printer illustrated in FIG. 4A to FIG. 4C, and is a partial cutaway view for illustrating a configuration in which a frictional-resistance member is provided to the first separation wall.

As illustrated in FIG. 4A to 4C, the thermal printer 1 according to this embodiment includes a first separation wall (separator) 80 in the recording-sheet receiving portion 10. The first separation wall 80 is configured to separate parts of the recording sheet 100 (roll sheet R), which is rolled into a roll shape around a core body 101, folded on each other at a rolling start portion 102, which is rolled around the core body 101 and has a turn-back shape. In the example illustrated in FIG. 4A to FIG. 4C, through the separation of the parts of the recording sheet 100 folded on each other by friction generated between the recording sheet 100 and the first separation wall 80, the rolling start portion 102 of the recording sheet 100 brought into abutment against the first separation wall 80 is conveyed to a position between the platen unit 4 and the head unit 5 with a thickness corresponding to that of one recording sheet 100.

Now, each component of the thermal printer 1 according to this embodiment is described.

The casing (printer main body) 2 is made of, for example, a resin material, a metal material, or an appropriate combination thereof, and is formed into a cube shape opened on the forward side FW. However, a shape of the casing 2 is not limited to the shape given in the illustrated example, and may be suitably changed in consideration of design and size.

Although detailed illustration is omitted, the casing 2 includes, for example, a frame body serving as a basic skeleton, and an exterior cover for covering the frame body. The recording-sheet receiving portion 10 configured to receive the roll sheet R is formed in the casing 2, and the recording-sheet receiving portion 10 is opened to the forward side FW by opening the printer cover 3.

The recording-sheet receiving portion 10 has a box shape that is formed of a part of the above-mentioned frame body (not shown) and is opened to the forward side FW. The recording-sheet receiving portion 10 is configured to receive the roll sheet R on an inner side thereof under a state in which a width direction of the roll sheet R is matched with the right-and-left direction L3.

A first pivot shaft 11 extending along the right-and-left direction L3 is arranged in a lower portion of an opening edge of the casing 2. The printer cover 3 is coupled to the first pivot shaft 11 so as to be pivotable with respect to the casing 2. The printer cover 3 pivots within an angle range of about 90° between the closed position (position illustrated in FIG. 1) at which an opening portion of the casing 2 is closed and the open position (position illustrated in FIG. 2) at which the opening portion of the casing 2 is opened. With this, the opening portion of the casing 2 (that is, the recording-sheet receiving portion 10) is opened and closed by the printer cover 3. When the printer cover 3 is at the open position, the recording-sheet receiving portion 10 is opened, and for example, the roll sheet R can be loaded into the recording-sheet receiving portion 10, and the thermal printer 1 is formed of so-called drop-in system.

The thermal printer 1 has a configuration in which a slight gap is formed between a distal end portion of the printer cover 3 and the casing 2 when the printer cover 3 is located at the closed position. The recording sheet 100 is pulled out from an inner portion of the casing 2 to the forward side FW through use of the gap. Accordingly, the "slight gap" described above serves as a delivery port 12 of the recording sheet 100.

When the printer cover 3 is located at the closed position, the casing 2 and the printer cover 3 are locked with each other along with combination of the platen unit 4 and the head unit 5. Further, of corner portions positioned on an upper front side of the casing 2, the corner portion positioned on one side in the right-and-left direction L3 is provided with an operation lever 13 configured to release the combination (locking state) between the platen unit 4 and the head unit 5 to perform an opening operation of the printer cover 3.

As illustrated in FIG. 2 and FIG. 3, the head unit 5 is a unit in which the thermal head (not shown) and a movable blade 22 are mainly incorporated, and is arranged on the upper front side inside the casing 2. The head unit 5 is fixed to an inner plate (not shown) extending downward from an upper surface of the casing 2 and is held on the forward side FW with respect to the recording-sheet receiving portion 10.

The head unit 5 mainly includes a head frame 23, the thermal head, the movable blade 22, a drive mechanism 24, an operation lever 25, a return mechanism 26, and an unlocking mechanism 27. The head frame 23 is formed of, for example, a frame made of metal. The thermal head (not shown) includes a plurality of heating elements arrayed in a line shape along the right-and-left direction L3.

The platen unit 4 is mounted on an upper portion of an inner surface of the printer cover 3 at a position at which the platen unit 4 overlaps with a reinforcing member 31 in the front-and-back direction L1 and is separably combined with the head unit 5 along with an opening/closing operation of the printer cover 3. Specifically, the platen unit 4 includes a fixed blade 34 and a platen frame 35 in addition to the platen roller 33.

The platen roller 33 is a roller configured to convey the recording sheet 100 to an outside of the printer cover 3. The fixed blade 34 is provided in the printer cover 3 and is arranged on the forward side FW with respect to the platen roller 33. The platen frame 35 is a frame configured to support the platen roller 33 and the fixed blade 34.

When the printer cover 3 is located at the closed position, the thermal head (not shown) is opposed to the platen roller 33 to allow passage of the recording sheet 100 between the thermal head and the platen roller 33. Further, a coil spring (not shown) configured to bias the thermal head downwardly (to the platen roller 33 side) is interposed between the thermal head and the platen roller 33. With this, the thermal head can be reliably pressed against the recording sheet 100 sent out by the platen roller 33, and satisfactory printing characteristic by the printing unit 8 can be obtained.

As illustrated in FIG. 3, the movable blade 22 is provided on the casing 2 (see FIG. 2) through intermediation of the drive mechanism 24. The movable blade 22 is arranged so as to be opposed to the fixed blade 34 in the front-and-back direction L1 under a state in which the printer cover 3 is located at the closed position (see FIG. 1) and in which the head unit 5 and the platen unit 4 are combined with each other. The movable blade 22 is a plate-like blade having a V shape formed so that a length from a root 22*a* to a blade edge 22*b* gradually becomes shorter from both ends to a center.

The movable blade 22 is mounted on drive racks 46 of the drive mechanism 24 through intermediation of a movable blade holder 29. The movable blade 22 is formed so as to be movable in the up-and-down direction L2 with respect to the head frame 23 due to the operation of the drive mechanism 24. With this, the movable blade 22 is supported so as to be movable with respect to the fixed blade 34 in the up-and-down direction L2.

The drive mechanism 24 illustrated in FIG. 3 is a mechanism configured to move the movable blade 22 to a cutting position and a standby position (position of the movable blade 22 in FIG. 3) with respect to the recording sheet 100. Although detailed illustration is omitted, the cutting position is a position at which the movable blade 22 rides on the fixed blade 34 to cut the recording sheet 100 together with the fixed blade 34. The standby position is a position at which the movable blade 22 is separated from the fixed blade 34, that is, the position of the movable blade 22 illustrated in FIG. 3. Specifically, the drive mechanism 24 includes a motor M1 for driving, first to fourth drive teeth 41 to 44, drive pinions 45, and the drive racks 46.

The motor M1 for driving is a motor capable of performing forward and reverse rotation. The first drive teeth 41 are coupled to a drive shaft of the motor M1 for driving. The first drive teeth 41 are coupled to the drive pinion 45 through intermediation of the second to fourth drive teeth 42 to 44. The drive pinion 45 is coaxially mounted on a pinion support shaft 48. The pinion support shaft 48 rotates integrally with the drive pinion 45. The drive pinions 45 are provided as a pair respectively on both sides in the right-and-left direction L3. The pair of drive pinions 45 are meshed with the drive racks 46 provided respectively on both sides in the right-and-left direction L3. The pair of drive pinions 45 are coupled to each other with the pinion support shaft 48.

Each of the drive racks 46 has a plurality of drive rack teeth 47 formed from an end portion (upper end portion) on the standby position side to an end portion (lower end portion) on the cutting position side. That is, the drive rack 46 has the drive rack teeth 47 formed in an entire region thereof. The drive racks 46 are mounted in both end portions of the movable blade holder 29 along the right-and-left direction L3 and extend along the up-and-down direction L2. That is, the movable blade 22 is mounted on the drive racks 46 through intermediation of the movable blade holder 29.

Now, for ease of understanding of the entire configuration of the thermal printer 1, the drive pinion 45 and the drive rack 46 on a side of the motor M1 for driving are described in detail. Description of the drive pinion 45 and the drive rack 46, which are located on a side opposite to the motor M1 for driving in the right-and-left direction L3, is herein omitted.

When the motor M1 for driving rotates forwardly, the rotation of the motor M1 for driving is transmitted to the drive pinion 45 through the first to fourth drive teeth 41 to 44. With this, the drive pinion 45 rotates in a direction of an arrow A illustrated in FIG. 3, and the drive rack 46 moves in a direction of an arrow B illustrated in FIG. 3 together with a return rack 64 of the return mechanism 26. When the drive rack 46 moves, the movable blade 22 linearly moves in the direction of the arrow B together with the drive rack 46. With this, the movable blade 22 can be moved to the cutting position.

Meanwhile, when the motor M1 for driving rotates reversely, the rotation of the motor M1 for driving is transmitted to the drive pinion 45 through the first to fourth drive teeth 41 to 44. The drive pinion 45 rotates in a direction of an arrow C illustrated in FIG. 3, and the drive rack 46 moves in a direction of an arrow D illustrated in FIG. 3. In this way, when the drive rack 46 moves, the movable blade 22 linearly moves in the direction of the arrow D together with the drive rack 46. With this, the movable blade 22 can be moved to the standby position.

The operation lever 25 is pivotably supported on the side wall portion side of the head frame 23 through intermediation of a lever support shaft 52. The operation lever 25 is configured so as to be able to perform a pushing operation backwardly (in the direction of the arrow BA) from a lock position to an abutment position or a releasing position described later about the lever support shaft 52 by an operation force μl. The lever support shaft 52 projects inward from an exterior cover of the casing 2.

Here, the lock position of the operation lever 25 is a position at which the platen unit 4 is kept in a locked state with respect to the head unit 5. The abutment position of the operation lever 25 is a position at which a lever projecting portion (not shown) provided to the operation lever 25 comes into abutment against a cam projecting portion (not shown) provided to a release cam 91. Further, the releasing position of the operation lever 25 is a position at which the locked state of the platen unit 4 with respect to the head unit 5 is released.

The operation lever 25 has a locking groove portion (not shown) formed in an outer surface 25*a*. A planetary shaft (not shown) is provided so as to project outward from the outer surface 25*a*. Further, the operation lever 25 has an inner surface on a side opposite to the outer surface 25*a*, and the lever projecting portion (not shown) projects inward from the inner surface.

A distal end portion 25*c* of the operation lever 25 is fitted on an inner side of a coupling member 16 (see FIG. 2) of the operation lever 13. Thus, the operation lever 25 is operated in association with the operation of the operation lever 13. With the operation described above, when the operation lever 13 is operated from the lock position to the releasing position, the operation lever 25 is operated from the lock position to the releasing position.

The return mechanism 26 is configured to return the movable blade 22 from the cutting position toward the standby position side. The return mechanism 26 moves the movable blade 22 toward the standby position side in association with the operation lever 25 under a state in which the movable blade 22 is stopped at the cutting position due to occurrence of a paper jam. Specifically, the return mechanism 26 includes an acceleration mechanism 61, a return pinion 63, and the return rack 64.

The acceleration mechanism 61 includes a sun gear (not shown), a planetary gear 67, and an internal gear (not shown). Further, the planetary gear 67 is arranged so as to mesh with the sun gear described above.

The planetary gear 67 is rotatably supported by the operation lever 25 through intermediation of the planetary shaft (not shown). The planetary shaft is arranged at a position offset from the lever support shaft 52. Thus, through the rotation of the operation lever 25 about the lever support shaft 52, the planetary shaft (specifically, the planetary gear 67) follows movement of the operation lever 25 to revolve about the lever support shaft 52.

The internal gear (not shown) is provided so as to be able to mesh with the planetary gear 67. The internal gear is formed so as to avoid meshing with the planetary gear 67 under a state in which the operation lever 25 is located at the lock position.

With the acceleration mechanism 61 having the configuration described above, as a result of the operation of the operation lever 25 from the lock position toward the abutment position or the releasing position, the planetary gear 67 follows the movement of the operation lever 25 to revolve toward the internal gear (not shown). Through the revolution of the planetary gear 67, the planetary gear 67 is meshed with the internal gear. With a further operation of the operation lever 25, the planetary gear 67 rotates while meshing with the internal gear.

Although detailed illustration is omitted, a biasing member 75 includes a coil portion, a first end portion 75*b*, and a second end portion. The coil portion is supported by a support pin (not shown). The first end portion 75*b* is locked to the exterior cover. The second end portion is locked in the locking groove portion (not shown) of the operation lever 25. With the configuration described above, the operation lever 25 is kept in a state of abutting against a lever stopper (not shown) with the biasing force of the biasing member 75 to be positioned at the lock position. However, the biasing member 75 is not limited to the configuration described above, and may be, for example, a flat spring.

Further, as a result of removal of the operation force from the operation lever 25 under a state in which the operation lever 25 is operated from the lock position to the abutment position or the releasing position against the biasing force of the biasing member 75, the operation lever 25 is returned to the lock position with an elastic restoring force (biasing force) of the biasing member 75.

As illustrated in FIG. 3, the return pinion 63 is arranged coaxially with the drive pinion 45 on an outer side thereof, and is rotatably supported by the pinion support shaft 48. That is, the return pinion 63 is coupled to the operation lever 25 so as to be able to operate in association with the operation lever 25. The return pinion 63 is formed so as to be meshed with a plurality of rack teeth 59 of the return rack 64. The return rack 64 is formed integrally with the drive rack 46 in a state of being arranged on an outer side of the drive rack 46 of the drive mechanism 24. The return rack 64 has the rack teeth 59 formed only on a side opposite to the blade edge 22*b* of the movable blade 22. Thus, the return rack 64 is meshed with the return pinion 63 when the movable blade 22 is located at the cutting position, and the meshing of the return rack 64 with the return pinion 63 is released when the movable blade 22 is located at the standby position.

Further, with the formation of the return rack 64 on the drive rack 46, the drive rack 46 and the return rack 64 can be formed integrally with each other. Thus, the return rack 64 can be formed without increasing the number of components. As a result, configurations of the printing unit 8 and the thermal printer 1 can be simplified, and at the same time, cost can be suppressed.

As illustrated in FIG. 3, the unlocking mechanism 27 is arranged on an inner side of the operation lever 25. The unlocking mechanism 27 is a mechanism configured to unlock the printer cover 3 in association with a pivoting operation of the operation lever 25. Specifically, the platen unit 4 is unlocked from the head unit 5 with use of the operation lever 25. The unlocking mechanism 27 includes the release cam 91, the lever projecting portion (not shown), and a cam stopper (not shown). The unlocking mechanism 27 is capable of unlocking the platen unit 4 from the head unit 5 with the configuration described above.

The thermal printer 1 according to this embodiment further includes a separator. When the recording sheet 100 rolled into a roll shape around the core body 101 is unrolled and conveyed to a gap portion S between the platen unit 4 and the head unit 5, the separator separates parts of the recording sheet 100 folded on each other at the rolling start portion 102, which is rolled around the core body 101 and has the turn-back shape.

Specifically, the thermal printer 1 according to this embodiment includes the first separation wall 80 as the separator described above. As illustrated in FIG. 4A to FIG. 4C, the first separation wall 80 is provided at a position at which, when the rolling start portion 102 of the recording sheet 100 is unrolled, at least a part of a peripheral surface of the rolling start portion 102 is brought into abutment against the first separation wall 80 along with a repulsive force generated by the stiffness of the recording sheet 100.

The first separation wall 80 is provided to the recording-sheet receiving portion 10 and is located in the vicinity of the roll sheet R. In the illustrated example, the first separation wall 80 is formed as a substantially L-shaped member including a short wall 81 and a long wall 82. The short wall 81 is arranged in the vicinity of a path of the recording sheet 100 unrolled from the roll sheet R. Further, the long wall 82 described above is mounted to an inner wall of the printer cover 3 so that the first separation wall 80 is supported.

A surface 81*a* of the short wall 81 of the first separation wall 80 functions as a surface against which the rolling start portion 102 of the unrolled recording sheet 100 is brought into abutment. Further, in FIG. 4A to FIG. 4C, the surface 81*a* of the short wall 81 is a surface oriented in the front-and-back direction L1 of FIG. 4A to FIG. 4C.

Through employment of the configuration including the first separation wall 80 as described above, the action described below can be obtained. First, the roll sheet R, which is obtained by rolling the recording sheet 100 into the roll shape around the core body 101 and is received in the recording-sheet receiving portion 10, is sequentially conveyed to a position between the platen unit 4 and the head unit 5 and subjected to thermal printing. After the thermal printing, the roll sheet R is cut by the movable blade 22 and the fixed blade 34 illustrated in FIG. 3 and is conveyed to the outside as, for example, a receipt.

After that, as illustrated in FIG. 4A, the recording sheet 100 of the roll sheet R is sequentially unrolled, and a portion of the rolling start portion 102 having the turn-back shape is finally separated from the core body 101. The rolling start portion 102 separated from the core body 101 is conveyed toward the gap portion S between the platen unit 4 and the head unit 5, and is brought into abutment against the surface 81*a* of the short wall 81 of the first separation wall 80. At this time, the rolling start portion 102 is brought into abutment against the surface 81*a* by the firmness (stiffness) given by the characteristic of the recording sheet 100 as paper.

As illustrated in FIG. 4B, after the rolling start portion 102 is brought into abutment against the surface 81*a* of the first separation wall 80, parts of the recording sheet 100 folded on each other are gradually separated by friction generated between the surface 81*a* and the peripheral surface of the recording sheet 100 (rolling start portion 102). Then, as illustrated in FIG. 4C, parts of the recording sheet 100 are completely separated without being folded on each other, and the rolling start portion 102 is conveyed toward the gap portion S between the platen unit 4 and the head unit 5 with a thickness corresponding to one recording sheet 100. After being subjected to the thermal printing and cutting, the recording sheet 100 is conveyed to the outside without causing, for example, a paper jam.

A material of the first separation wall 80 is not particularly limited. For example, a material which is capable of securing a constant frictional force with respect to the recording sheet 100 can be suitably employed. Such a material is not particularly limited, and a material which is the same as a resin material forming the platen unit 4 and the head unit 5 of the thermal printer 1 can be used. For example, an acrylonitrile butylene styrene (ABS) resin or a polycarbonate (PC) resin may be suitably used.

With the configuration including the first separation wall 80 as in this embodiment, as mentioned above, the recording sheet 100 which is unrolled from the core body 101 and is curled is brought into abutment against the surface 81*a* of the first separation wall 80 by the stiffness of the recording sheet, and one part of the recording sheet 100 on the surface 81*a* side at the rolling start portion 102 stays due to the friction generated with the surface 81*a*, and only another part of the recording sheet 100 at the rolling start portion 102 is pulled in a sheet-passage direction. With this, a relative action between parts of the recording sheet 100 folded on each other at the rolling start portion 102 causes the rolling start portion 102 to be conveyed to the gap portion S between the head unit 5 and the platen unit 4 while being opened, that is, while the parts of the recording sheet 100 are separated. Accordingly, passage of the rolling start portion 102 while keeping the turn-back shape can be prevented. That is, the recording sheet 100 is conveyed in a state without overlapping conveyance, which is a normal conveyance. Therefore, for example, a paper jam does not occur in the thermal printer 1, and the last part of the recording sheet 100 is allowed to pass even at a timing immediately before the roll sheet R (recording sheet 100) runs out. With this, a leading edge 100*a* of the recording sheet 100 passes in the vicinity of a sheet run-out sensor (not shown), and sheet run-out detection can be normally performed, thereby being capable of also preventing erroneous detection by the sheet run-out sensor.

Further, according to this embodiment, with the simple configuration of only providing the first separation wall 80, the turn-back shape at the rolling start portion 102 of the recording sheet 100 can be opened and eliminated. Accordingly, the paper jam that occurs inside and the erroneous detection by the sheet run-out sensor can be avoided without causing a significant increase in cost, thereby leading to improvement in performance of the thermal printer.

In this embodiment, in the configuration including the first separation wall 80 described above, it is preferred that the short wall 81 provided to the first separation wall 80 be provided so as to pressurize at least a part of the peripheral surface of the rolling start portion 102 of the recording sheet 100. That is, it is preferred that the surface 81*a* of the short wall 81 be located at a position on a conveyance path of the recording sheet 100 at which the surface 81*a* can pressurize the recording sheet 100 having a tendency to be curled as in the example illustrated in FIG. 4A to FIG. 4C (for example, position closer to a second separation wall 90 described later).

As described above, as the first separation wall 80 pressurizes at least a part of the peripheral surface of the rolling start portion 102 of the recording sheet 100, the frictional force generated between the first separation wall 80 and the peripheral surface of the recording sheet 100 increases, thereby being capable of more effectively separating the parts of the recording sheet 100 folded on each other at the rolling start portion 102.

The separator in this embodiment is not limited to the configuration described above. For example, it is more preferred that, as in the example illustrated in FIG. 5, a configuration in which a frictional-resistance member 83 is provided to the first separation wall 80 at a position at which at least a part of the peripheral surface of the rolling start portion 102 of the recording sheet 100 is brought into abutment be employed.

As described above, as the frictional-resistance member 83 is provided at the position on the first separation wall 80 at which the rolling start portion 102 of the recording sheet 100 is brought into abutment, a frictional force generated between the frictional-resistance member 83 and the peripheral surface of the recording sheet 100 increases, thereby being capable of more effectively separating the parts of the recording sheet 100 folded on each other at the rolling start portion 102.

A material of the frictional-resistance member 83 is also not particularly limited, and any material having a friction coefficient capable of achieving a high frictional force with respect to the recording sheet 100, for example, a polyurethane foam or various rubber materials can be used without limitation.

Figure 6A:
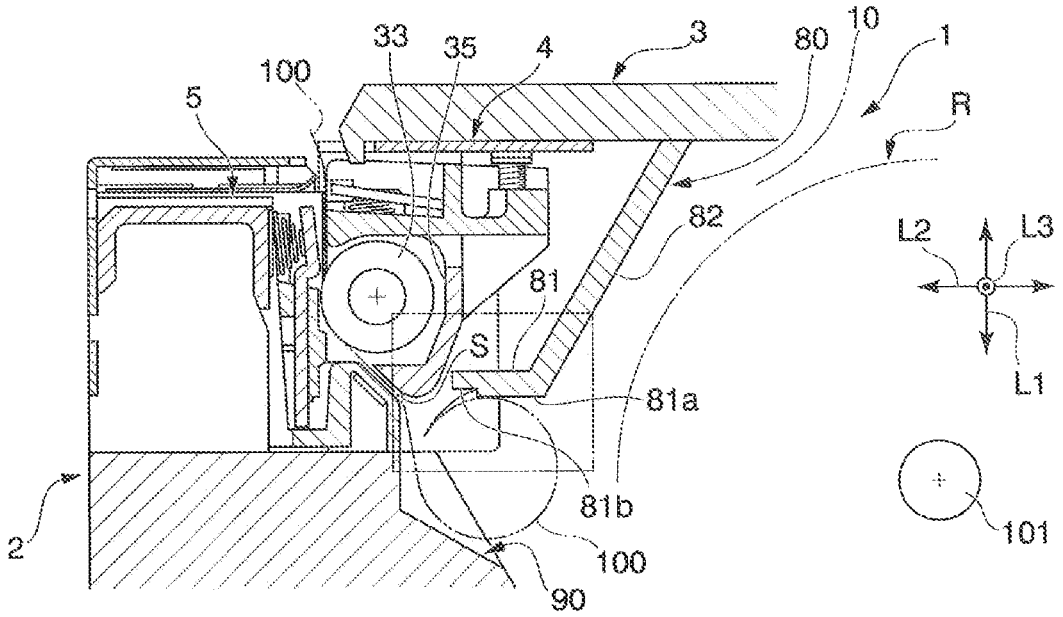
FIG. 6A is a view for schematically illustrating the thermal printer according to the first embodiment of the present invention, is a view for illustrating a modification example of the thermal printer illustrated in FIG. 4A to FIG. 4C, and is a partial cutaway view for illustrating a configuration in which a locking portion having a recess shape is provided to the first separation wall.
Figure 6B:
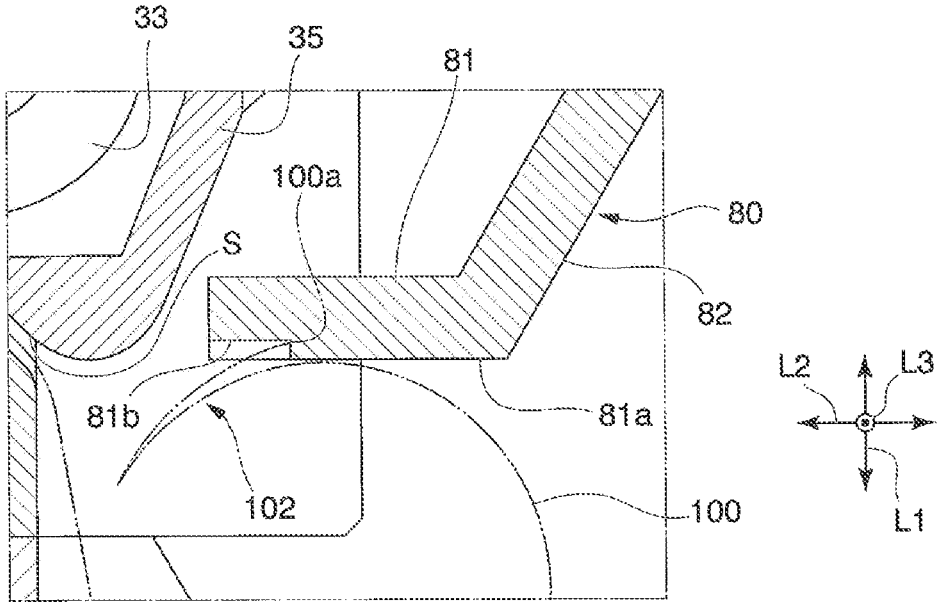
FIG. 6B is a view for schematically illustrating the thermal printer according to the first embodiment of the present invention, and is a partial enlarged view for illustrating a main part of FIG. 6A.
Figure 7:
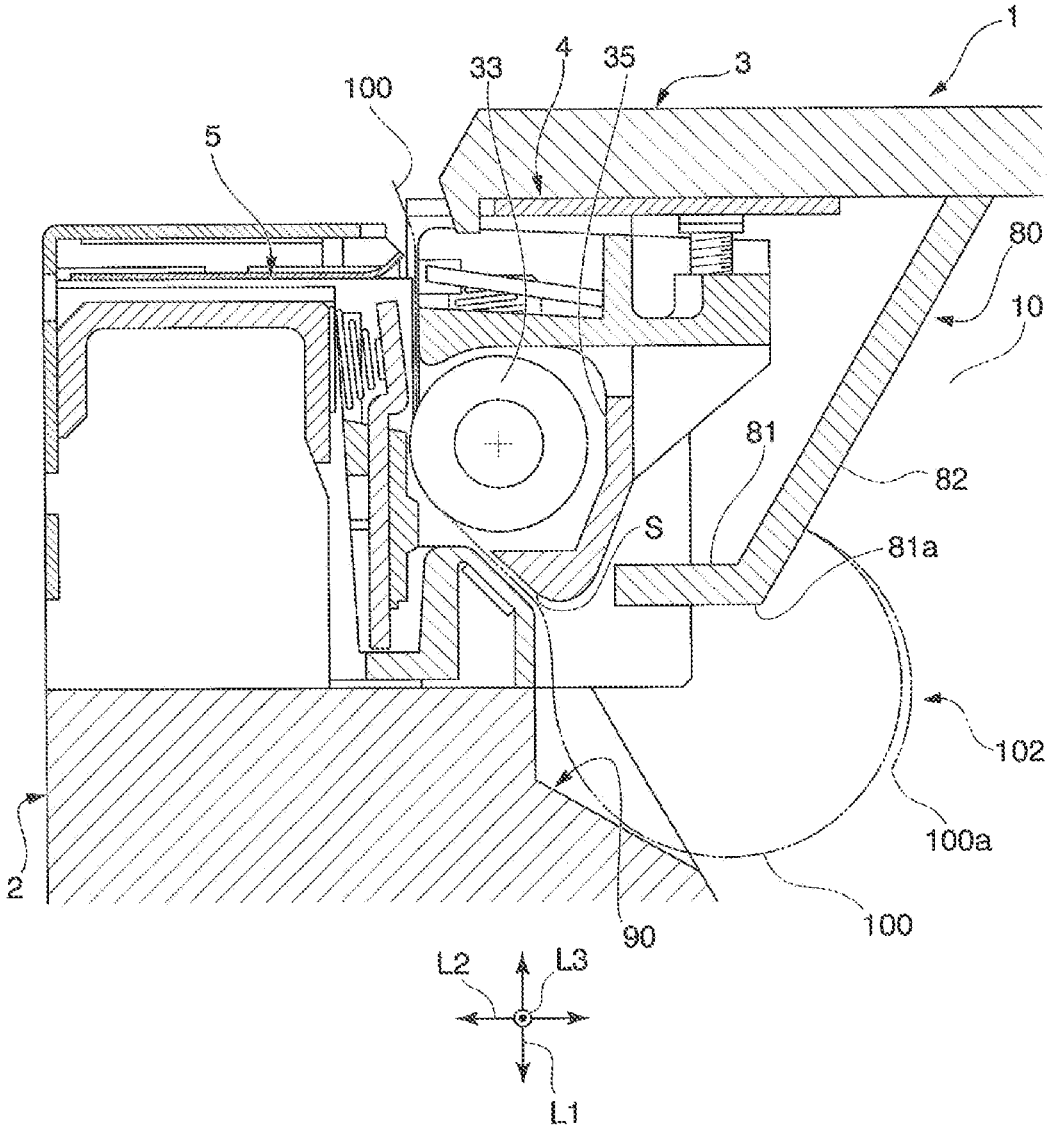
FIG. 7 is a view for schematically illustrating the thermal printer according to the first embodiment of the present invention, and is a partial cutaway view for illustrating a relationship of the first separation wall and a second separation wall provided to the recording-sheet receiving portion with respect to the rolling start portion of the recording sheet formed into the turn-back shape when the rolling start portion of the recording sheet is significantly curled.

Further, in this embodiment, it is preferred that a configuration in which a locking portion 81*b* configured to lock the leading edge 100*a* formed into the turn-back shape at the rolling start portion 102 is provided to the first separation wall 80 at a position at which at least a part of the peripheral surface of the rolling start portion 102 of the recording sheet 100 is brought into abutment as in the example illustrated in FIG. 6A and FIG. 6B be employed. In the illustrated example, the locking portion 81*b* having a recess shape is provided at a distal end of the short wall 81 of the first separation wall 80.

As described above, as the locking portion 81*b* is provided at the position on the first separation wall 80 at which the rolling start portion 102 of the recording sheet 100 is brought into abutment, the leading edge 100*a* formed into the turn-back shape at the rolling start portion 102 is locked to the locking portion 81*b*, thereby being capable of more effectively separating the parts of the recording sheet 100 folded on each other at the rolling start portion 102. At this time, with the configuration in which the leading edge 100*a* formed into the turn-back shape is engaged with the locking portion 81*b* and turns toward a direction opposite to an advancing direction of the recording sheet 100 through a sheet-passage path of the recording sheet 100, the rolling start portion 102 is brought into a floating state, thereby being capable of effectively separating the parts of the recording sheet 100 folded on each other. In the illustrated example, the locking portion 81*b* having a recess shape is provided to the short wall 81. However, the present invention is not limited to this configuration. For example, the effect described above can be obtained also when a locking portion having a protrusion shape is provided.

According to the thermal printer 1 of this embodiment, with the configuration including the first separation wall 80, the effect of separating the parts of the recording sheet 100 folded on each other at the rolling start portion 102 as described above can be obtained. In addition, it is more preferred that the second separation wall 90 illustrated in FIG. 4A to FIG. 4C, FIG. 5, and FIG. 6A be further provided. In the illustrated example, the second separation wall 90 is provided in the recording-sheet receiving portion 10 at the position of being opposed to the first separation wall 80 across the unrolled recording sheet 100 and at which at least a part of the peripheral surface of the rolling start portion 102 is brought into abutment along with the repulsive force generated by the stiffness of the recording sheet 100.

As described above, as the second separation wall 90 is provided at the position of being opposed to the first separation wall 80 and at which the peripheral surface of the rolling start portion 102 is brought into abutment, the recording sheet 100 which is unrolled from the core body 101 and is curled is brought into abutment against the above-mentioned first separation wall 80 by the stiffness of the recording sheet 100 and is brought into abutment also against the second separation wall 90. With this, owing to the friction between both of the first separation wall 80 and the second separation wall 90 and the peripheral surface of the recording sheet 100, the effect of reliably separating the parts of the recording sheet 100 folded on each other at the rolling start portion 102 can be obtained (see also the example illustrated in FIG. 7).

Further, with the second separation wall 90 having the configuration described above, for example, as illustrated in FIG. 7, a large diameter of the core body (not shown) causes a diameter of the curling of the rolling start portion 102 to become larger. Therefore, even when it is difficult to bring the peripheral surface of the rolling start portion 102 into abutment against the first separation wall 80, the rolling start portion 102 is brought into abutment against the second separation wall 90, thereby being adaptable to roll sheets having various core diameters.

Further, in this embodiment, through the employment of the configuration in which the first separation wall 80 is mounted to the printer cover 3 and in which the second separation wall 90 is mounted to the casing 2, the parts of the recording sheet 100 folded on each other at the rolling start portion 102 can be effectively separated while improving the ease of assembly and maintenance at the time of manufacture of the thermal printer 1.

Second Embodiment

Now, a thermal printer 1A according to a second embodiment of the present invention is described mainly with reference to FIG. 8A, FIG. 8B, FIG. 9A, and FIG. 9B as appropriate. In the thermal printer 1A according to the second embodiment described below, components which are in common with the thermal printer 1 according to the first embodiment mentioned above are denoted by the same reference symbols in the drawings, and detailed description thereof is omitted in some cases.

Figure 8A:
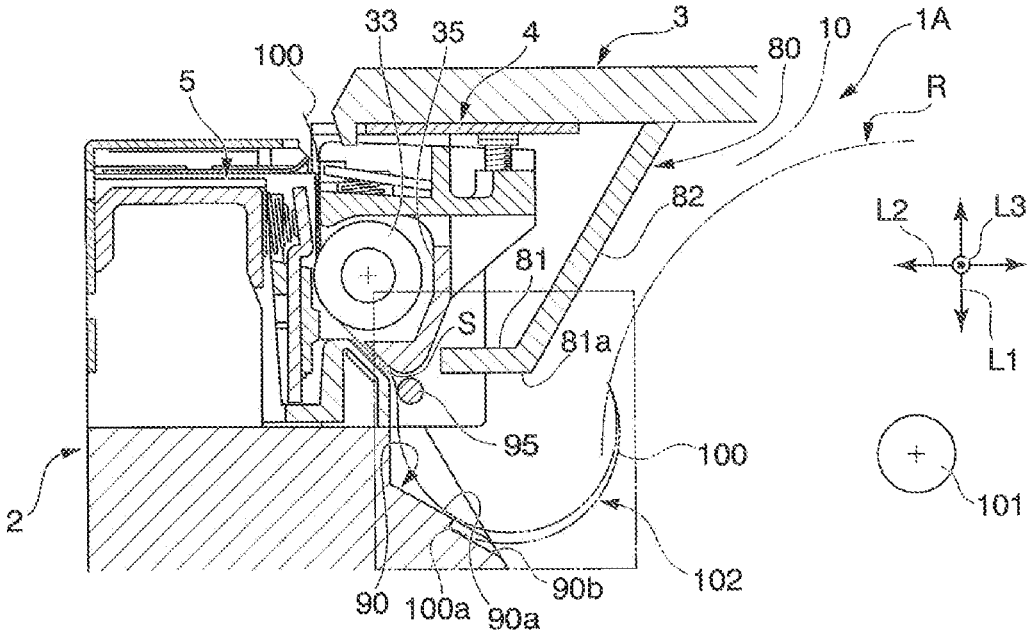
FIG. 8A is a view for schematically illustrating a thermal printer according to a second embodiment of the present invention, and is a partial cutaway view for illustrating a configuration in which a locking portion having a recess shape and a guide portion formed of a turnable guide shaft are provided to the second separation wall illustrated in FIG. 7.
Figure 8B:
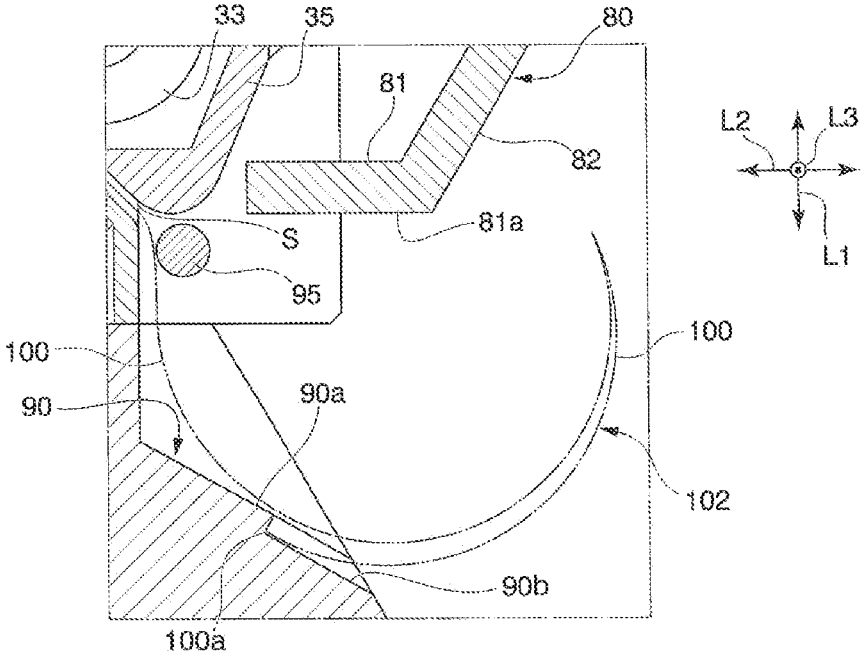
FIG. 8B is a view for schematically illustrating the thermal printer according to the second embodiment of the present invention, and is a partial enlarged view for illustrating a main part of FIG. 8A.

FIG. 8A is a view for illustrating the thermal printer 1A according to the second embodiment, and is a partial cutaway view for illustrating a relationship of the first separation wall 80 and the second separation wall 90 provided to the recording-sheet receiving portion 10 with respect to the rolling start portion 102 formed into the turn-back shape when the rolling start portion 102 of the recording sheet 100 is significantly curled. FIG. 8B is an enlarged view for illustrating a main part of FIG. 8A. The thermal printer 1A according to the second embodiment illustrated in FIG. 8A and FIG. 8B further includes a guide portion in addition to the first separation wall 80 and the second separation wall 90 provided to the thermal printer 1 illustrated in FIG. 7. The guide portion is located at a position of being opposed to the second separation wall 90 across the unrolled recording sheet 100 and in the vicinity of an inlet of the gap portion S to which the recording sheet 100 is conveyed, and is configured to guide the recording sheet 100. In the example illustrated in FIG. 8A and FIG. 8B, the thermal printer 1A employs a configuration in which the guide portion is formed of a guide shaft 95 which is in parallel with the core body (that is, shaft portion) 101 (see, for example, FIG. 4A) of the recording sheet 100 and is pivotable.

According to the thermal printer 1A of this embodiment, the guide portion formed of the guide shaft 95 configured to guide the recording sheet 100 is provided to the platen unit 4, and hence, as illustrated in FIG. 8A and FIG. 8B, the rolling start portion 102 of the recording sheet 100 is reliably brought into abutment against the second separation wall 90. That is, even when the recording sheet 100 which is unrolled from the core body 101 and is significantly curled is not brought into abutment against the first separation wall 80, the recording sheet 100 is brought into abutment against the second separation wall 90 by a guiding action of the guide shaft 95. The recording sheet 100 is caused to stay by the friction generated with a surface 90*a* of the second separation wall 90, and only another part of the recording sheet 100 at the rolling start portion 102 is pulled in the sheet-passage direction. Then, as in the case of the first embodiment, the rolling start portion 102 is opened by a relative action between parts of the recording sheet 100 folded on each other at the rolling start portion 102, and the recording sheet 100 is conveyed to the gap portion S between the head unit 5 and the platen unit 4 while the parts of the recording sheet 100 are separated, thereby being capable of preventing passage of the rolling start portion 102 keeping the turn-back shape. Accordingly, as in the case described above, the recording sheet 100 is conveyed in a state without overlapping conveyance. Therefore, a paper jam or the like does not occur in the thermal printer 1A, and the last part of the recording sheet 100 is allowed to pass even at a timing immediately before the roll sheet R (see, for example, FIG. 4A) runs out. Further, erroneous detection by the sheet run-out sensor can also be prevented.

Also in this embodiment, similarly to the case of the first separation wall 80 in the first embodiment, as illustrated in FIG. 8A and FIG. 8B, at the position of the second separation wall 90 at which at least a part of the peripheral surface of the rolling start portion 102 of the recording sheet 100 is brought into abutment, it is preferred that a locking portion 90*b* having a recess shape configured to lock the leading edge 100*a* of the rolling start portion 102 formed into the turn-back shape be provided. Through employment of such a configuration including the locking portion 90*b*, the leading edge 100*a* at the rolling start portion 102 is locked to the locking portion 90*b*. Therefore, an action of more effectively separating the parts of the recording sheet 100 folded on each other at the rolling start portion 102 can be obtained. Further, also in this embodiment, similarly to the case of the first embodiment, the locking portion provided to the second separation wall 90 is not limited to the one having the recess shape as in the illustrated example, and a locking portion having a protrusion shape can also be provided.

Further, although detailed illustration is omitted, in place of the locking portion described above, there can also be employed a configuration in which a frictional-resistance member is provided at the position on the surface 90*a* of the second separation wall 90 at which at least a part of the peripheral surface of the rolling start portion 102 of the recording sheet 100 is brought into abutment. As described above, with the frictional-resistance member provided to the surface 90*a* of the second separation wall 90, similarly to the case of the first separation wall 80 of the first embodiment, a frictional force generated between the frictional-resistance member (not shown) and the peripheral surface of the recording sheet 100 increases, thereby being capable of more effectively separating the parts of the recording sheet 100 folded on each other at the rolling start portion 102.

Although detailed illustration is omitted in FIG. 8A and FIG. 8B, as the guide shaft 95, there may be used a guide shaft obtained by, for example, assembling a roller made of a rubber material or a resin material (for example, ABS resin or PC resin) to a core shaft made of, for example, a stainless steel material.

Further, also in the case in which the frictional-resistance member (not shown) is provided to the surface 90*a* of the second separation wall 90, there may be used the frictional-resistance member made of the same material as the frictional-resistance member 83 provided to the thermal printer 1 according to the above-mentioned first embodiment.

Figure 9A:
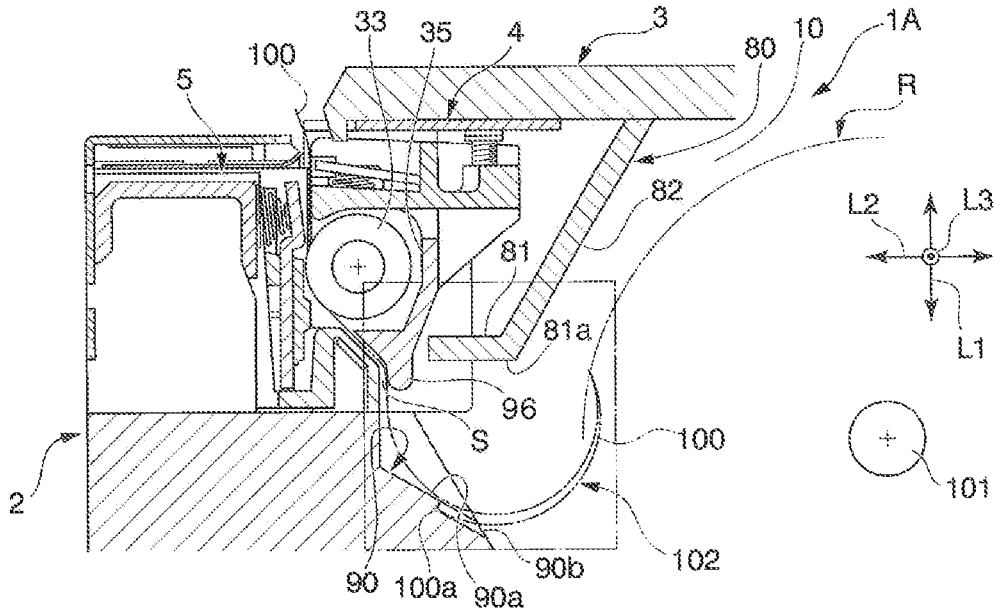
FIG. 9A is a view for schematically illustrating the thermal printer according to the second embodiment of the present invention, and is a partial cutaway view for illustrating a configuration in which the locking portion having the recess shape and the guide portion formed of a guide wall projecting so as to be opposed to the second separation wall are provided to the second separation wall illustrated in FIG. 7.
Figure 9B:
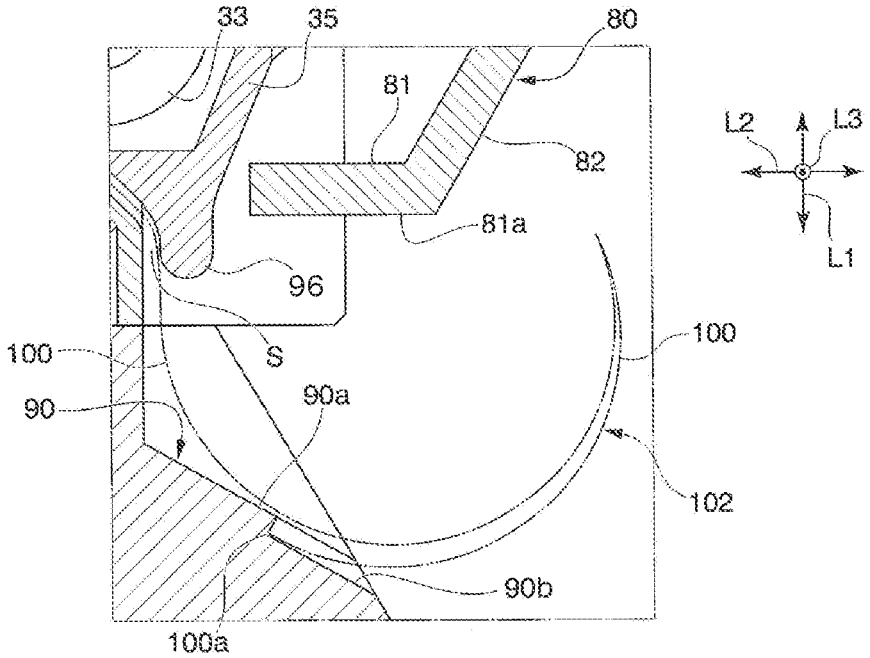
FIG. 9B is a view for schematically illustrating the thermal printer according to the second embodiment of the present invention, and is a partial enlarged view for illustrating a main part of FIG. 9A.

The guide portion described in this embodiment is not limited to the guide portion formed of the pivotable guide shaft 95 exemplified in FIG. 8A and FIG. 8B. For example, as illustrated in FIG. 9A and FIG. 9B, the guide portion may be formed of a guide wall 96, which is provided in the vicinity of the platen roller 33 of the platen unit 4 and projects from the platen frame 35 so as to be opposed to the second separation wall 90. Here, FIG. 9A is a partial cutaway view for illustrating a relationship of the first separation wall 80 and the second separation wall 90 provided to the recording-sheet receiving portion 10 with respect to the rolling start portion 102 formed into the turn-back shape in a case in which the guide portion is formed of the guide wall 96 and in which the rolling start portion 102 of the recording sheet 100 is significantly curled. FIG. 9B is an enlarged view for illustrating a main part of FIG. 9A.

Even in the case in which the guide wall 96 illustrated in FIG. 9A and FIG. 9B is provided, similarly to the case in which the guide shaft 95 described above is provided, the recording sheet 100 can be reliably guided to be brought into abutment against the second separation wall 90, thereby being capable of reliably separating the parts of the recording sheet 100 folded on each other at the rolling start portion 102. Further, with the guide portion formed of the guide wall 96, the guide portion can be formed integrally with the resin member forming the platen unit 4, thereby being capable of improving the productivity of the thermal printer 1A and reducing the manufacturing cost.

Third Embodiment

Figure 10A:
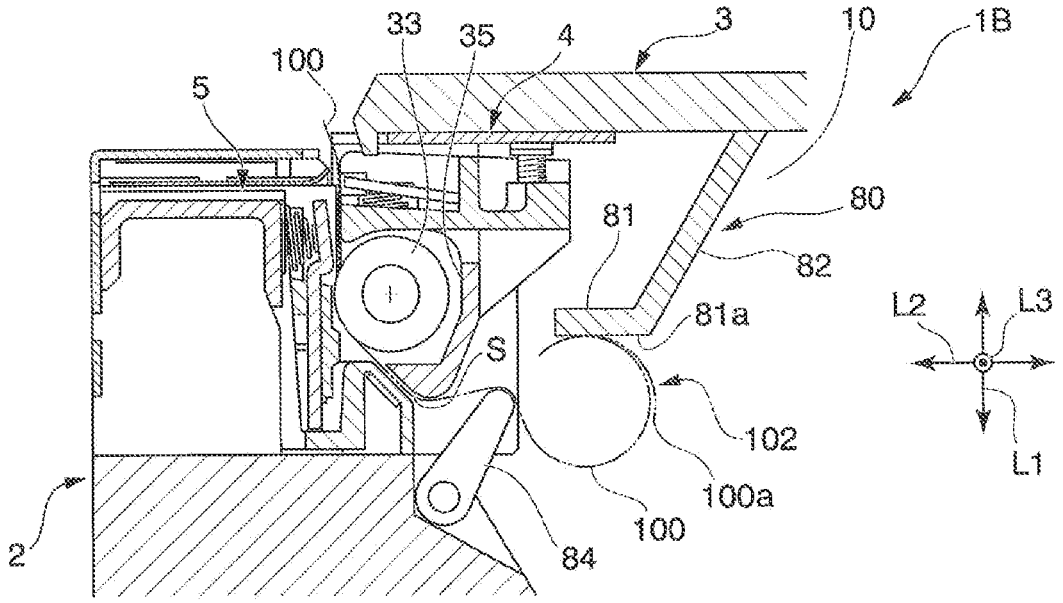
FIG. 10A is a view for schematically illustrating a thermal printer according to a third embodiment of the present invention, and is a partial cutaway view for illustrating a relationship of the first separation wall and a tension bar provided to the recording-sheet receiving portion with respect to the rolling start portion of the recording sheet formed into the turn-back shape.
Figure 10B:
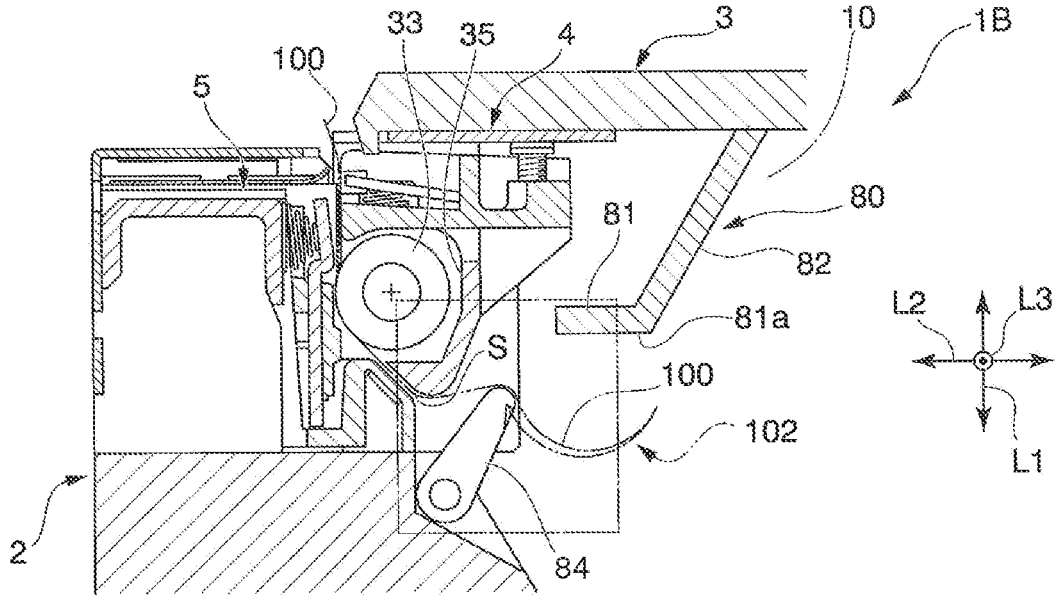
FIG. 10B is a view for schematically illustrating the thermal printer according to the third embodiment of the present invention, and is a partial cutaway view for illustrating a relationship of the first separation wall and the tension bar provided to the recording-sheet receiving portion with respect to the rolling start portion of the recording sheet formed into the turn-back shape.
Figure 10C:
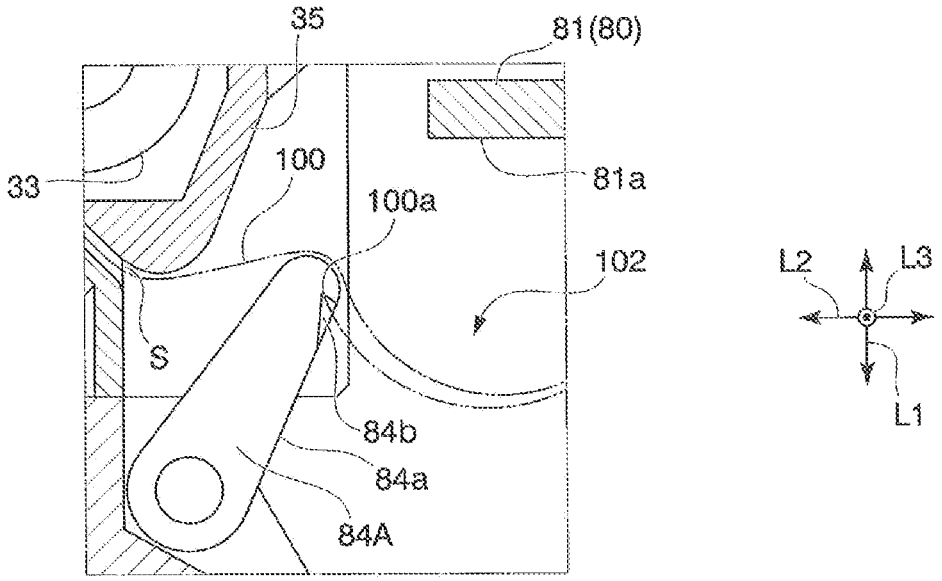
FIG. 10C is a view for schematically illustrating the thermal printer according to the third embodiment of the present invention, and is a partial enlarged view for illustrating a main part of FIG. 10B.

Now, a thermal printer 1B according to a third embodiment of the present invention is described mainly with reference to FIG. 10A, FIG. 10B, and FIG. 10C as appropriate. In the thermal printer 1B according to the third embodiment described below, components which are in common with the thermal printer 1 and 1A according to the first and the second embodiments mentioned above are denoted by the same reference symbols in the drawings, and detailed description thereof is omitted in some cases.

FIG. 10A is a view for illustrating the thermal printer 1B according to the third embodiment, and is a partial cutaway view for illustrating a relationship of the first separation wall 80 and a tension bar 84 provided to the recording-sheet receiving portion 10 with respect to the rolling start portion 102 of the recording sheet 100 formed into the turn-back shape.

According to the thermal printer 1B of this embodiment, with the tension bar 84 described above, as illustrated in FIG. 10A, the recording sheet 100 is guided by the tension bar 84 so that the rolling start portion 102 of the recording sheet 100 is reliably brought into abutment in a pressurized state against the first separation wall 80. That is, the recording sheet 100 which is unrolled from the core body 101 (see, for example, FIG. 4A) and is curled is brought into abutment against the first separation wall 80 by a guiding action of the tension bar 84. The recording sheet 100 is caused to stay by the friction generated with the surface 81*a* of the first separation wall 80, and only another part of the recording sheet 100 at the rolling start portion 102 is pulled in the sheet-passage direction. Then, as in the case of the first and the second embodiments, the rolling start portion 102 is opened by a relative action between parts of the recording sheet 100 folded on each other at the rolling start portion 102, and the recording sheet 100 is conveyed to the gap portion S between the head unit 5 and the platen unit 4 while the parts of the recording sheet 100 are separated, thereby being capable of preventing passage of the rolling start portion 102 keeping the turn-back shape. Accordingly, as in the case described above, the recording sheet 100 is conveyed in a state without overlapping conveyance. Therefore, a paper jam or the like does not occur in the thermal printer 1B, and the last part of the recording sheet 100 is allowed to pass even at a timing immediately before the roll sheet R (see, for example, FIG. 4A) runs out. Further, erroneous detection by the sheet run-out sensor can also be prevented.

A material used for the tension bar 84 is not particularly limited, and a material which is the same as a resin material used for each member forming the platen unit 4 can be used. Examples of the material include an ABS resin and a PC resin, and the tension bar 84 can be obtained by, for example, injection molding using those resin materials. Further, the tension bar 84 can be formed of, for example, a coil spring (not shown) so as to be pressurized and urged against the recording sheet 100.

Further, the tension bar provided to the thermal printer 1B according to this embodiment is not limited to the configuration described above, and there may be employed, for example, a tension bar 84A as illustrated in FIG. 10B and FIG. 10C. The tension bar 84A has a configuration in which a locking portion 84*b* configured to lock the leading edge 100*a* of the recording sheet 100 formed into the turn-back shape at the rolling start portion 102 is provided at a part of the surface 84*a*. FIG. 10B is a partial cutaway view for illustrating a relationship of the first separation wall 80 and the tension bar 84A provided to the recording-sheet receiving portion 10 with respect to the rolling start portion 102 of the recording sheet 100 formed into the turn-back shape when the tension bar 84A to which the locking portion 84*b* is provided is employed. FIG. 10C is a partial enlarged view for illustrating a main part of FIG. 10B. As in the illustrated example, the locking portion 84*b* is formed on the surface 84*a* of the tension bar 84A at a position at which the leading edge 100*a* forming the rolling start portion 102 of the recording sheet 100 is brought into abutment.

Through employment of the tension bar 84A having the configuration in which the locking portion 84*b* is provided as illustrated in FIG. 10B and FIG. 10C, when the recording sheet 100 is guided to the first separation wall 80 by the tension bar 84A, the leading edge 100*a* formed into the turn-back shape at the rolling start portion 102 is locked to the locking portion 84*b*. Accordingly, the parts of the recording sheet 100 folded on each other at the rolling start portion 102 can be more effectively separated.

Description has been given of the example in which the locking portion 84*b* is provided to the surface 84*a* of the tension bar 84A with reference to FIG. 10B and FIG. 10C. However, this embodiment is not limited to such a configuration. For example, even in a case of a configuration in which a locking portion having a protrusion shape (not shown) or a friction-resistance member is provided in place of the locking portion 84*b* of the tension bar 84A at the same position is employed, similarly to the example described above, the parts of the recording sheet 100 folded on each other at the rolling start portion 102 can be more effectively separated.

Fourth Embodiment

Figure 11A:
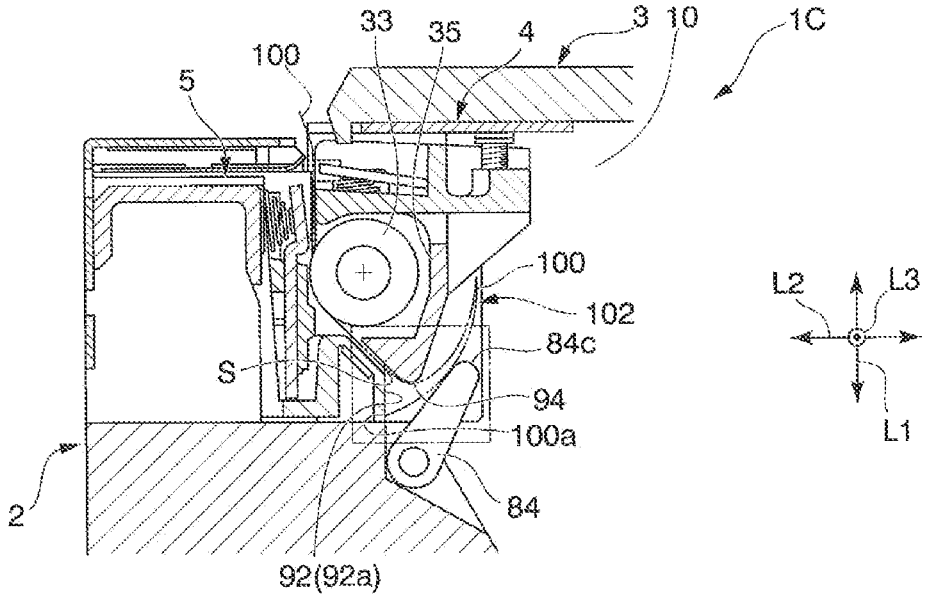
FIG. 11A is a view for schematically illustrating a thermal printer according to a fourth embodiment of the present invention, and is a partial cutaway view for illustrating a relationship of a third separation wall, the tension bar, and the guide wall provided to the recording-sheet receiving portion with respect to the rolling start portion of the recording sheet formed into the turn-back shape.
Figure 11B:
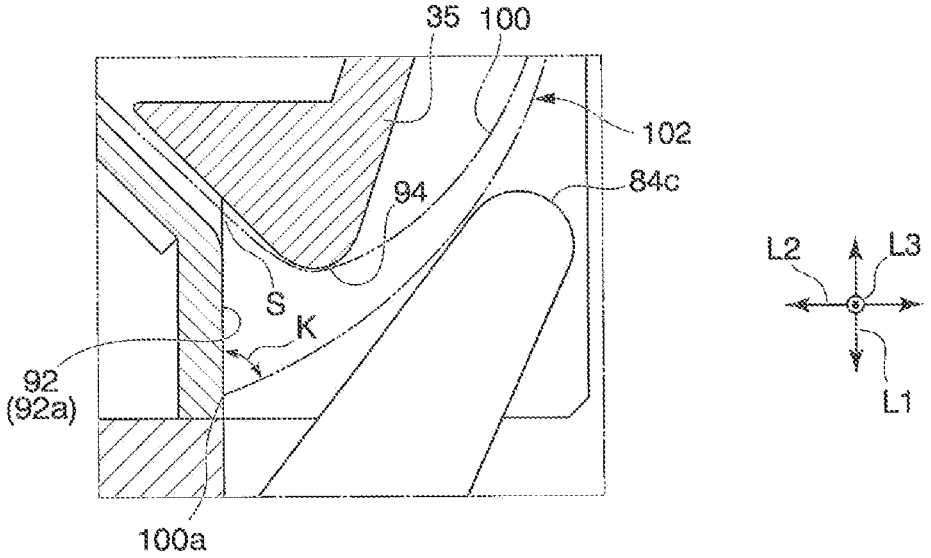
FIG. 11B is a view for schematically illustrating the thermal printer according to the fourth embodiment of the present invention, and is a partial enlarged view for illustrating a main part of FIG. 11A.

Now, a thermal printer 1C according to a fourth embodiment of the present invention is described mainly with reference to FIG. 11A and FIG. 11B as appropriate. In the thermal printer 1C according to the fourth embodiment described below, components which are in common with the thermal printer 1, 1A, and 1B according to the first to third embodiments mentioned above are denoted by the same reference symbols in the drawings, and detailed description thereof is omitted in some cases.

FIG. 11A is a view for illustrating the thermal printer 1C according to the fourth embodiment, and is a partial cutaway view for illustrating a relationship of a third separation wall 92, the tension bar 84, and a guide wall 94 provided to the recording-sheet receiving portion 10 with respect to the rolling start portion 102 of the recording sheet 100 formed into the turn-back shape. FIG. 11B is a partial enlarged view for illustrating a main part of FIG. 11A.

The thermal printer 1C according to the fourth embodiment illustrated in FIG. 1A and FIG. 11B is different from the thermal printer 1B according to the third embodiment illustrated in, for example, FIG. 10A in that the first separation wall 80 is not provided. Meanwhile, the thermal printer 1C according to this embodiment includes the tension bar 84 configured to guide the recording sheet 100 toward the platen unit 4 side at a position of being opposed to the platen unit 4 across the unrolled recording sheet 100. Further, the thermal printer 1C includes the guide wall (guide portion) 94. The guide wall 94 is provided so as to be opposed to the tension bar 84 at a position in the vicinity of the inlet of the gap portion S to which the recording sheet 100 is conveyed in the platen unit 4, and the recording sheet 100 guided by the tension bar 84 toward the platen unit 4 side is brought into abutment against the guide wall 94. This guide wall 94 is formed such that a part of the platen frame 35 provided to the platen unit 4 projects. Further, the thermal printer 1C includes the third separation wall 92. The third separation wall 92 is provided on a side opposite to the guide wall 94 across the gap portion S in the vicinity of the inlet of the gap portion S, and at least a part of the recording sheet 100 guided by the tension bar 84 and the guide wall 94 is brought into abutment against the third separation wall 92.

Further, in this embodiment, a distal end 84*c* of the tension bar 84 and a distal end of the guide wall 94 are arranged so as to overlap each other in a direction in which the platen unit 4 and the tension bar 84 are opposed to each other. That is, in the example illustrated in FIG. 11A and FIG. 11B, the distal end of the guide wall 94 provided to the platen unit 4 is arranged so as to project downward in the direction L of FIG. 11A and FIG. 11B (that is, downward in the vertical direction of FIG. 11A and FIG. 11B) as compared to the distal end 84*c* of the tension bar 84.

In the thermal printer 1C illustrated in FIG. 11A and FIG. 11B, the sheet-passage path of the recording sheet 100 is sharply changed toward the tension bar 84 side by the guide wall 94 provided such that a part of the platen frame 35 provided to the platen unit 4 projects. Further, the tension bar 84, the guide wall 94, and the third separation wall 92 are arranged such that an angle K of the recording sheet 100 with respect to the surface 92*a* of the third separation wall 92 becomes less than 90° when the leading edge 100*a* of the rolling start portion 102 of the recording sheet 100 is brought into abutment against the third separation wall 92.

According to the thermal printer 1C of this embodiment, with the tension bar 84, the guide wall 94, and the third separation wall 92 described above, as illustrated in FIG. 11A and FIG. 11B, first, the recording sheet 100 is guided by the tension bar 84 so that the rolling start portion 102 of the recording sheet 100 is brought into abutment in a pressurized state against the guide wall 94. At this time, as the distal end 84*c* of the tension bar 84 and the distal end of the guide wall 94 pressurize the recording sheet 100 from both surface sides, the recording sheet 100 is formed into a shape of sharply turning at the distal end of the guide wall 94, and hence the turn-back shape of the rolling start portion 102 is opened. With this, the leading edge 100*a* of the recording sheet 100 at the rolling start portion 102 is brought into abutment against the third separation wall 92 so that the recording sheet 100 is conveyed to the gap portion S between the head unit 5 and the platen unit 4 while the parts of the recording sheet 100 are separated, thereby being capable of preventing passage of the rolling start portion 102 keeping the turn-back shape. Accordingly, as in the case described above, the recording sheet 100 is conveyed in a state without overlapping conveyance. Therefore, a paper jam or the like does not occur in the thermal printer 1C, and the last part of the recording sheet 100 is allowed to pass even at a timing immediately before the roll sheet R (see, for example, FIG. 4A) runs out. Further, erroneous detection by the sheet run-out sensor can also be prevented.

In the viewpoint of allowing the turn-back shape of the rolling start portion 102 to be easily opened, it is preferred that a gap between the tension bar 84 and the guide wall 94 be regulated to be as narrow as possible. Further, in the viewpoint of allowing the turn-back shape of the rolling start portion 102 to be easily opened, it is preferred that, as described above, the tension bar 84, the guide wall 94, and the third separation wall 92 be arranged such that the angle K of the recording sheet 100 with respect to the surface 92*a* of the third separation wall 92 becomes less than 90° when the leading edge 100*a* of the recording sheet 100 is brought into abutment against the third separation wall 92.

Also as the tension bar 84 used in this embodiment, a tension bar made of the material described in the third embodiment can be employed. Further, also as the configuration for pressurizing and urging the recording sheet 100, there can be employed the configuration of using the coil spring (not shown) or the like described in the third embodiment.

Figure 12A:
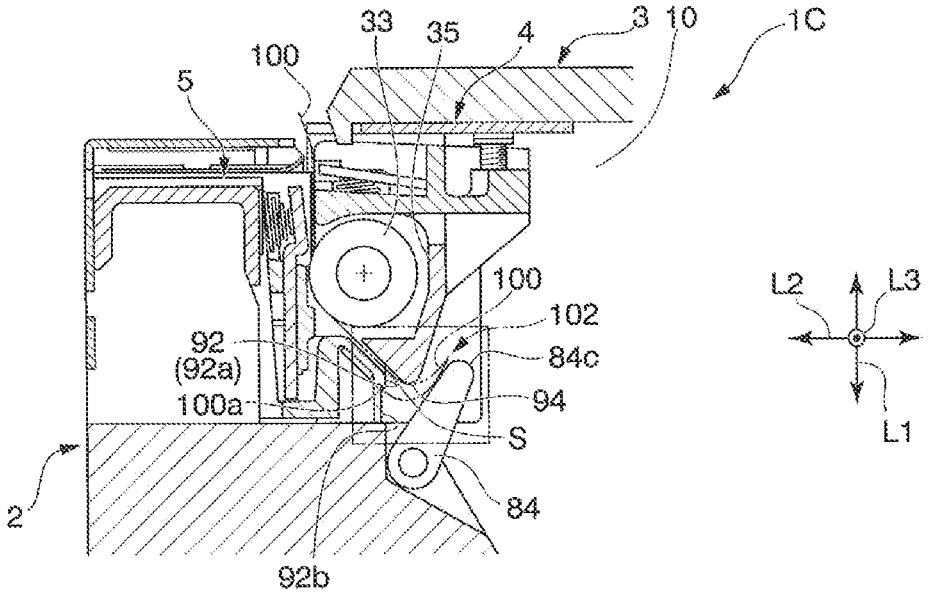
FIG. 12A is a view for schematically illustrating the thermal printer according to the fourth embodiment of the present invention, is a view for illustrating a main part of the thermal printer, and is a partial cutaway view for illustrating a configuration in which a locking portion having a recess shape is provided to the third separation wall.
Figure 12B:
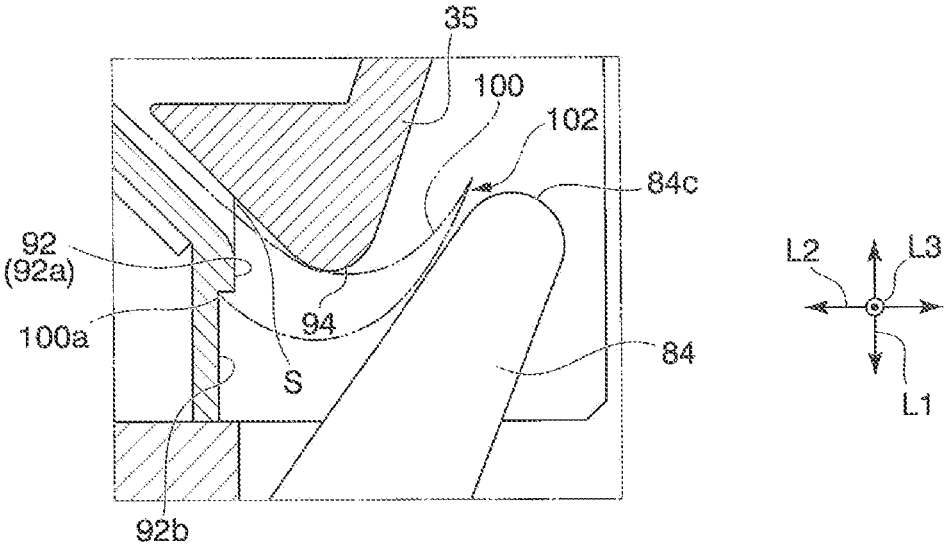
FIG. 12B is a view for schematically illustrating the thermal printer according to the fourth embodiment of the present invention, and is a partial enlarged view for illustrating a main part of FIG. 12A.

Further, in this embodiment, it is preferred that, as in the example illustrated in FIG. 12A and FIG. 12B, a configuration in which a locking portion 92*b* configured to lock the leading edge 100*a* formed into the turn-back shape is provided at the position on the surface 92*a* of the third separation wall 92 at which at least a part of the peripheral surface of the rolling start portion 102 of the recording sheet 100 is brought into abutment be employed.

As described above, with the locking portion 92*b* provided to the third separation wall 92, the leading edge 100*a* formed into the turn-back shape at the rolling start portion 102 is locked to the locking portion 92*b*, thereby being capable of more effectively separating parts of the recording sheet 100 folded on each other. Further, with the locking portion 92*b* provided to the third separation wall 92, the action of effectively separating the parts of the recording sheet 100 folded on each other can be obtained regardless of the angle at which the leading edge 100*a* of the recording sheet 100 is brought into abutment against the surface 92*a* of the third separation wall 92. In the illustrated example, the locking portion 92*b* having a recess shape is provided to the third separation wall 92, but the present invention is not limited to such a configuration. For example, the effect described above can be obtained even in a case in which the locking portion having a protrusion shape is provided.

Fifth Embodiment

Figure 13:
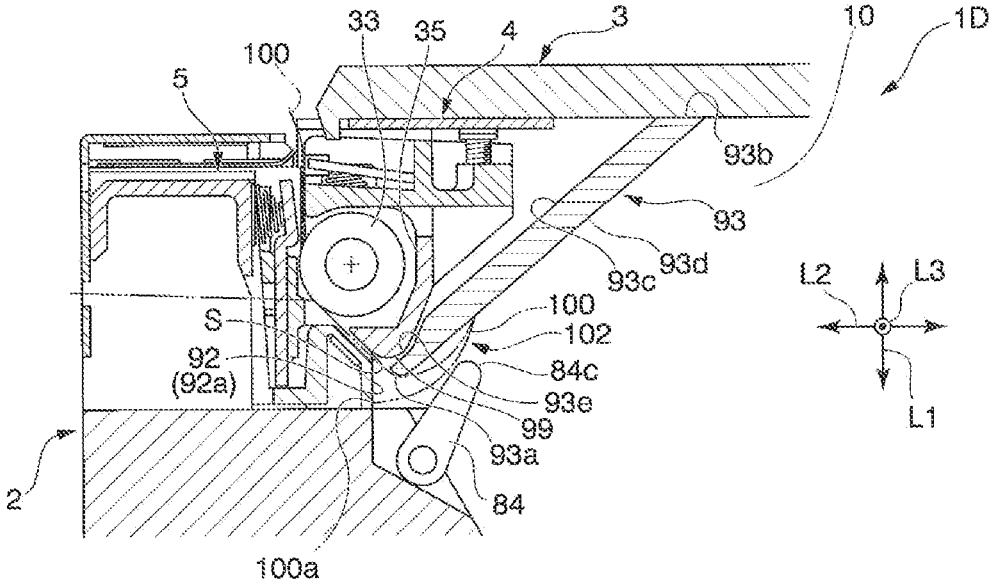
FIG. 13 is a view for schematically illustrating a thermal printer according to a fifth embodiment of the present invention, and is a partial cutaway view for illustrating a relationship of the third separation wall, the tension bar, and a lower end of the platen unit provided to the recording-sheet receiving portion with respect to the rolling start portion of the recording sheet formed into the turn-back shape.

Now, a thermal printer 1D according to a fifth embodiment of the present invention is described mainly with reference to FIG. 13 as appropriate. In the thermal printer 1D according to the fifth embodiment described below, components which are in common with the thermal printer 1, 1A, 1B, and 1C according to the first to fourth embodiments mentioned above are denoted by the same reference symbols in the drawings, and detailed description thereof is omitted in some cases.

FIG. 13 is a view for illustrating the thermal printer 1D according to the fifth embodiment, and is a partial cutaway view for illustrating a relationship of the third separation wall 92, the tension bar 84, and a lower end 99 of the platen unit 4 provided to the recording-sheet receiving portion 10 with respect to the rolling start portion 102 of the recording sheet 100 formed into the turn-back shape. The thermal printer 1D according to this embodiment includes the tension bar 84, a fourth separation wall 93, and the third separation wall 92. The tension bar 84 is configured to guide the recording sheet 100 toward the platen unit 4 side at a position of being opposed to the platen unit 4 across the recording sheet 100. The fourth separation wall 93 is arranged between the platen unit 4 and the tension bar 84, and is configured to guide the recording sheet 100 between the fourth separation wall 93 and the tension bar 84. The third separation wall 92 is provided in the vicinity of the inlet of the gap portion S, and at least a part of the recording sheet 100 guided by the tension bar 84 and the fourth separation wall 93 is brought into abutment the third separation wall 92.

The thermal printer 1D according to this embodiment illustrated in FIG. 13 is different from the thermal printer 1C according to the fourth embodiment illustrated in FIG. 11A and FIG. 11B in that the fourth separation wall 93 described above is further provided. Further, the thermal printer 1D according to this embodiment is different from the thermal printer 1C according to the fourth embodiment also in that the guide wall which significantly projects is not provided to the platen frame 35 of the platen unit 4.

The fourth separation wall 93 is provided to the recording-sheet receiving portion 10 and located in the vicinity of the roll sheet R, and is a member having a substantially plate shape arranged between the platen unit 4 and the tension bar 84 as described above. The fourth separation wall 93 has one end 93*a* side arranged between the platen unit 4 and the tension bar 84. Along with this arrangement, one surface 93*c* of the fourth separation wall 93 on the one end 93*a* side is formed as a recess-shaped region 93*e* that gently recesses in conformity with a round outer shape of the lower end 99 of the platen frame 35. Further, another surface 93*d* of the fourth separation wall 93 on a side opposite to the one surface 93*c* described above functions as a surface against which the rolling start portion 102 of the unrolled recording sheet 100 is brought into abutment.

Further, the fourth separation wall 93 is arranged such that the one end 93*a* overlaps the distal end 84*c* of the tension bar 84 in the direction in which the platen unit 4 (platen frame 35) and the tension bar 84 are opposed to each other. Further, another end 93*b* side is mounted to an inner wall of the printer cover 3 so that the fourth separation wall 93 in the illustrated example is supported.

According to the thermal printer 1D of this embodiment, with the tension bar 84, the fourth separation wall 93, and the third separation wall 92 described above, as illustrated in FIG. 13, first, the recording sheet 100 is guided by the tension bar 84, and the rolling start portion 102 of the recording sheet 100 is brought into abutment against the lower end 99 of the platen frame 35. At this time, unlike the case of the thermal printer 1C according to the fourth embodiment, the sheet-passage path of the recording sheet 100 is formed into a relatively gently curved shape.

Then, the turn-back shape of the rolling start portion 102 of the recording sheet 100 allowed to pass between the tension bar 84 and the fourth separation wall 93 is opened. With this, the leading edge 100*a* of the recording sheet 100 at the rolling start portion 102 is brought into abutment against the third separation wall 92 so that the recording sheet 100 is conveyed to the gap portion S between the head unit 5 and the platen unit 4 while the parts of the recording sheet 100 are separated, thereby being capable of preventing passage of the rolling start portion 102 keeping the turn-back shape. Accordingly, as in the case described above, the recording sheet 100 is conveyed in a state without overlapping conveyance. Therefore, a paper jam or the like does not occur in the thermal printer 1D, and the last part of the recording sheet 100 is allowed to pass even at a timing immediately before the roll sheet R (see, for example, FIG. 4A) runs out. Further, erroneous detection by the sheet run-out sensor can also be prevented.

A material of the fourth separation wall 93 is not particularly limited, and there may be used, for example, similarly to the first separation wall 80 provided to the thermal printer 1 according to the first embodiment, a material which is the same as the resin material forming the platen unit 4 and the head unit 5, such as an ABS resin or a PC resin.

Further, in this embodiment, through the employment of the configuration in which the fourth separation wall 93 is mounted to the printer cover 3, the parts of the recording sheet 100 folded on each other at the rolling start portion 102 can be effectively separated while improving the ease of assembly and maintenance at the time of manufacture of the thermal printer 1D.

Sixth Embodiment

Figure 14A:
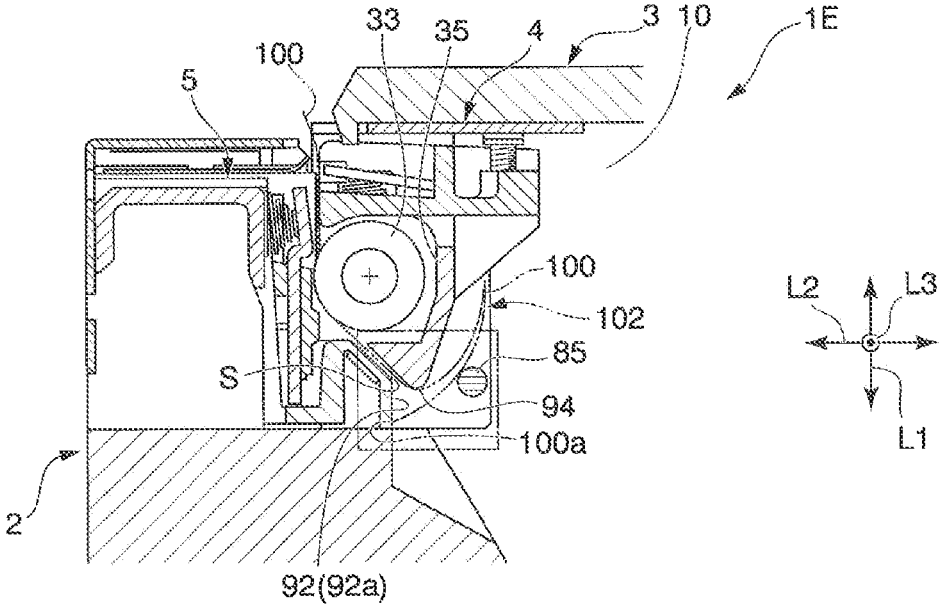
FIG. 14A is a view for schematically illustrating a thermal printer according to a sixth embodiment of the present invention, and is a partial cutaway view for illustrating a relationship of the second separation wall, the guide wall, and a guide roller provided to the recording-sheet receiving portion with respect to the rolling start portion of the recording sheet formed into the turn-back shape.
Figure 14B:
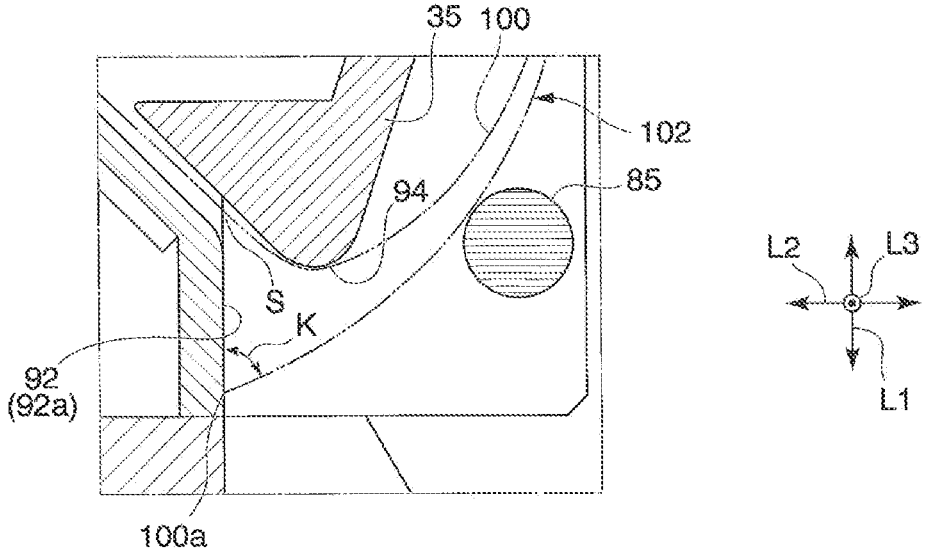
FIG. 14B is a view for schematically illustrating the thermal printer according to the sixth embodiment of the present invention, and is a partial enlarged view for illustrating a main part of FIG. 14A.

Now, a thermal printer 1E according to a sixth embodiment of the present invention is described mainly with reference to FIG. 14A and FIG. 14B as appropriate. In the thermal printer 1E according to the sixth embodiment described below, components which are in common with the thermal printer 1, 1A, 1B, 1C, and 1D according to the first to fifth embodiments mentioned above are denoted by the same reference symbols in the drawings, and detailed description thereof is omitted in some cases.

FIG. 14A is a view for illustrating the thermal printer 1E according to the sixth embodiment, and is a cutaway view for illustrating a relationship of the third separation wall 92, the guide wall 94, and a guide roller 85 provided to the recording-sheet receiving portion 10 with respect to the rolling start portion 102 of the recording sheet 100 formed into the turn-back shape. FIG. 14B is an enlarged view for illustrating a main part of FIG. 14A. The thermal printer 1E according to this embodiment includes the third separation wall 92, the guide wall 94, and the guide roller 85. The third separation wall 92 is provided on a side opposite to the guide wall 94 across the gap portion S in the vicinity of the inlet of the gap portion S, and at least a part of the recording sheet 100 is brought into abutment against the third separation wall 92. The guide wall 94 is provided at a position in the vicinity of the inlet of the gap portion S to which the recording sheet 100 is conveyed in the platen unit 4. The guide roller 85 is provided in the vicinity of the guide wall 94, and is configured to guide the recording sheet 100 between the guide roller 85 and the guide wall 94.

In the thermal printer 1E illustrated in FIG. 14A and FIG. 14B, the guide wall 94, which is provided such that a part of the platen frame 35 provided to the platen unit 4 projects, and the guide roller 85 are arranged in such a relationship that the sheet-passage path of the recording sheet 100 is sharply changed. Further, the guide roller 85, the guide wall 94, and the third separation wall 92 are arranged such that the angle K of the recording sheet 100 with respect to the surface 92*a* of the third separation wall 92 becomes less than 90° when the leading edge 100*a* of the rolling start portion 102 of the recording sheet 100 is brought into abutment against the third separation wall 92.

According to the thermal printer 1E of this embodiment, with the guide roller 85, the guide wall 94, and the third separation wall 92 described above, as illustrated in FIG. 14A and FIG. 14B, first, the recording sheet 100 is guided by the guide roller 85 so that the rolling start portion 102 of the recording sheet 100 is brought into abutment in a pressurized state against the guide wall 94. At this time, as the guide roller 85 and the distal end of the guide wall 94 pressurize the recording sheet 100 from both surface sides, the recording sheet 100 is formed into a shape of sharply turning at the distal end of the guide wall 94, and hence the turn-back shape of the rolling start portion 102 is opened. With this, as in the case of the fourth embodiment, the leading edge 100*a* of the recording sheet 100 at the rolling start portion 102 is brought into abutment against the third separation wall 92 so that the recording sheet 100 is conveyed to the gap portion S between the head unit 5 and the platen unit 4 while the parts of the recording sheet 100 are separated, thereby being capable of preventing passage of the rolling start portion 102 keeping the turn-back shape. Accordingly, as in the case described above, the recording sheet 100 is conveyed in a state without overlapping conveyance. Therefore, a paper jam or the like does not occur in the thermal printer 1E, and the last part of the recording sheet 100 is allowed to pass even at a timing immediately before the roll sheet R (see, for example, FIG. 4A) runs out. Further, erroneous detection by the sheet run-out sensor can also be prevented.

Also in this embodiment, as in the case of the fourth embodiment, in the viewpoint of allowing the turn-back shape of the rolling start portion 102 to be easily opened, it is preferred that a gap between the guide roller 85 and the guide wall 94 be regulated to be as narrow as possible. Further, as in the case of the fourth embodiment, in the viewpoint of allowing the turn-back shape of the rolling start portion 102 to be easily opened, it is preferred that the guide roller 85, the guide wall 94, and the third separation wall 92 be arranged such that the angle K of the recording sheet 100 with respect to the surface 92*a* of the third separation wall 92 becomes less than 90° when the leading edge 100*a* of the recording sheet 100 is brought into abutment against the third separation wall 92.

As the guide roller 85 used in this embodiment, similarly to the guide shaft 95 in the thermal printer 1A according to the second embodiment mentioned above, there may be used a guide roller obtained by, for example, assembling a roller made of a rubber material or a resin material, such as an ABS resin or a PC resin, to a core shaft made of, for example, a stainless steel material.

Seventh Embodiment

Figure 15A:
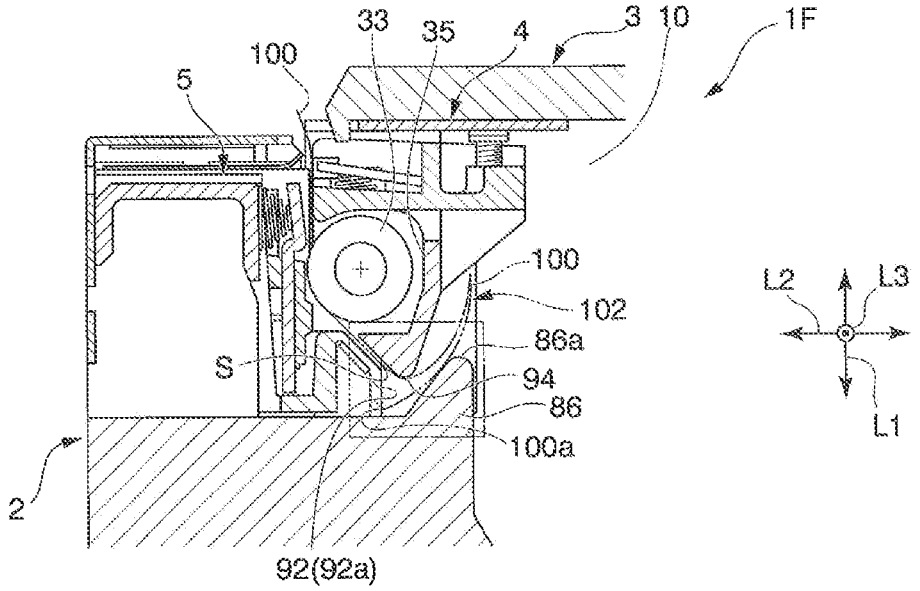
FIG. 15A is a view for schematically illustrating a thermal printer according to a seventh embodiment of the present invention, and is a partial cutaway view for illustrating a relationship of the third separation wall, the guide wall, and a regulation wall provided to the recording-sheet receiving portion with respect to the rolling start portion of the recording sheet formed into the turn-back shape.
Figure 15B:
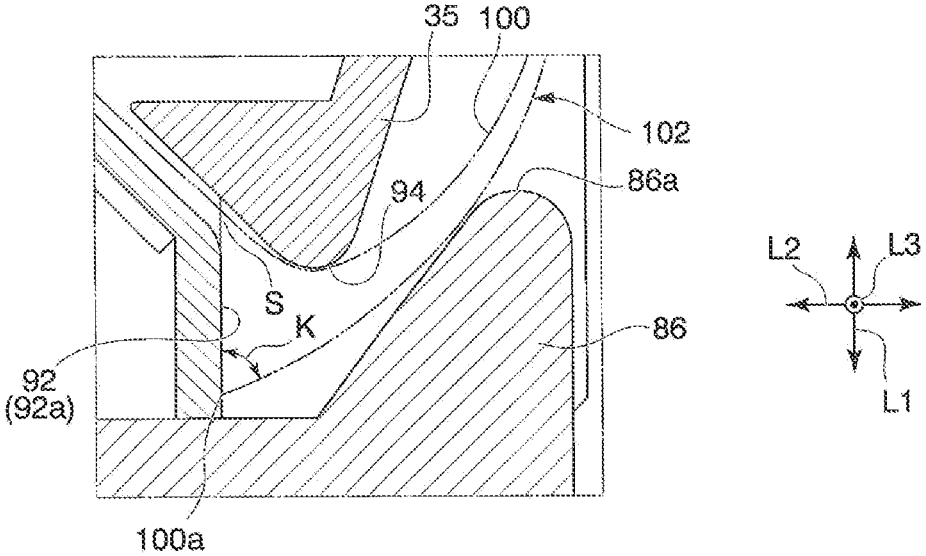
FIG. 15B is a view for schematically illustrating the thermal printer according to the seventh embodiment of the present invention, and is a partial enlarged view for illustrating a main part of FIG.

Now, a thermal printer 1F according to a seventh embodiment of the present invention is described mainly with reference to FIG. 15A and FIG. 15B as appropriate. In the thermal printer 1F according to the seventh embodiment described below, components which are in common with the thermal printer 1, 1A, 1B, 1C, 1D, and 1E according to the first to sixth embodiments mentioned above are denoted by the same reference symbols in the drawings, and detailed description thereof is omitted in some cases.

FIG. 15A is a view for illustrating the thermal printer 1F according to the seventh embodiment, and is a partial cutaway view for illustrating a relationship of the third separation wall 92, the guide wall 94, and a regulation wall 86 provided to the recording-sheet receiving portion 10 with respect to the rolling start portion 102 of the recording sheet 100 formed into the turn-back shape. FIG. 15B is an enlarged view for illustrating a main part of FIG. 15A. The thermal printer 1F according to this embodiment includes the third separation wall 92, the guide wall 94, and the regulation wall 86. The third separation wall 92 is provided on a side opposite to the guide wall 94 across the gap portion S in the vicinity of the inlet of the gap portion S, and at least a part of the recording sheet 100 is brought into abutment against the third separation wall 92. The guide wall 94 is provided at a position in the vicinity of the inlet of the gap portion S to which the recording sheet 100 is conveyed in the platen unit 4. The regulation wall 86 is provided so as to be opposed to the guide wall 94 across the recording sheet 100.

In this embodiment, a distal end 86*a* of the regulation wall 86 and the distal end of the guide wall 94 are arranged so as to overlap each other in a direction in which the platen unit 4 and the regulation wall 86 are opposed to each other. That is, in the example illustrated in FIG. 15A and FIG. 15B, the distal end of the guide wall 94 provided to the platen unit 4 is arranged so as to project downward in the direction L1 of FIG. 15A and FIG. 15B (that is, downward in the vertical direction of FIG. 15A and FIG. 15B) as compared to the distal end 86*a* of the regulation wall 86.

In the thermal printer 1F illustrated in FIG. 15A and FIG. 15B, the guide wall 94, which is provided such that a part of the platen frame 35 provided to the platen unit 4 projects, and the regulation wall 86 are arranged in such a relationship that the sheet-passage path of the recording sheet 100 is sharply changed. Further, as in the case described above, the regulation wall 86, the guide wall 94, and the third separation wall 92 are arranged such that the angle K of the recording sheet 100 with respect to the surface 92*a* of the third separation wall 92 becomes less than 90° when the leading edge 100*a* of the rolling start portion 102 of the recording sheet 100 is brought into abutment against the third separation wall 92.

According to the thermal printer 1F of this embodiment, with the regulation wall 86, the guide wall 94, and the third separation wall 92 described above, as illustrated in FIG. 15A and FIG. 15B, first, the recording sheet 100 is guided by the distal end 86*a* of the regulation wall 86 so that the rolling start portion 102 of the recording sheet 100 is brought into abutment in a pressurized state against the guide wall 94. At this time, as the distal end 86*a* of the regulation wall 86 and the distal end of the guide wall 94 pressurize the recording sheet 100 from both surface sides, the recording sheet 100 is formed into a shape of sharply turning at the distal end of the guide wall 94, and hence the turn-back shape of the rolling start portion 102 is opened. With this, the leading edge 100*a* of the recording sheet 100 at the rolling start portion 102 is brought into abutment against the third separation wall 92 so that the recording sheet 100 is conveyed to the gap portion S between the head unit 5 and the platen unit 4 while the parts of the recording sheet 100 are separated, thereby being capable of preventing passage of the rolling start portion 102 keeping the turn-back shape. Accordingly, as in the case described above, the recording sheet 100 is conveyed in a state without overlapping conveyance. Therefore, a paper jam or the like does not occur in the thermal printer 1F, and the last part of the recording sheet 100 is allowed to pass even at a timing immediately before the roll sheet R (see, for example, FIG. 4A) runs out. Further, erroneous detection by the sheet run-out sensor can also be prevented.

In the viewpoint of allowing the turn-back shape of the rolling start portion 102 to be easily opened, it is preferred that, similarly to the case described above, a gap between the distal end 86*a* of the regulation wall 86 and the guide wall 94 also be regulated to be as narrow as possible. Further, as in the case described above, in the viewpoint of allowing the turn-back shape of the rolling start portion 102 to be easily opened, it is preferred that the regulation wall 86, the guide wall 94, and the third separation wall 92 be arranged such that the angle K of the recording sheet 100 with respect to the surface 92*a* of the third separation wall 92 becomes less than 90° when the leading edge 100*a* of the recording sheet 100 is brought into abutment against the third separation wall 92.

Eighth Embodiment

Figure 16A:
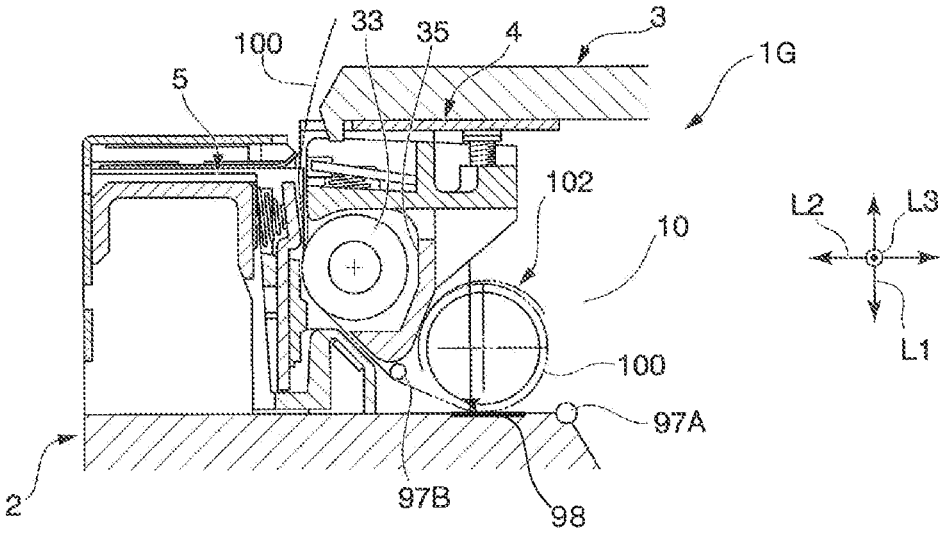
FIG. 16A is a view for schematically illustrating a thermal printer according to an eighth embodiment of the present invention, and is a partial cutaway view for illustrating a relationship of a pair of guide rolls with respect to the rolling start portion of the recording sheet formed into the turn-back shape.
Figure 16B:
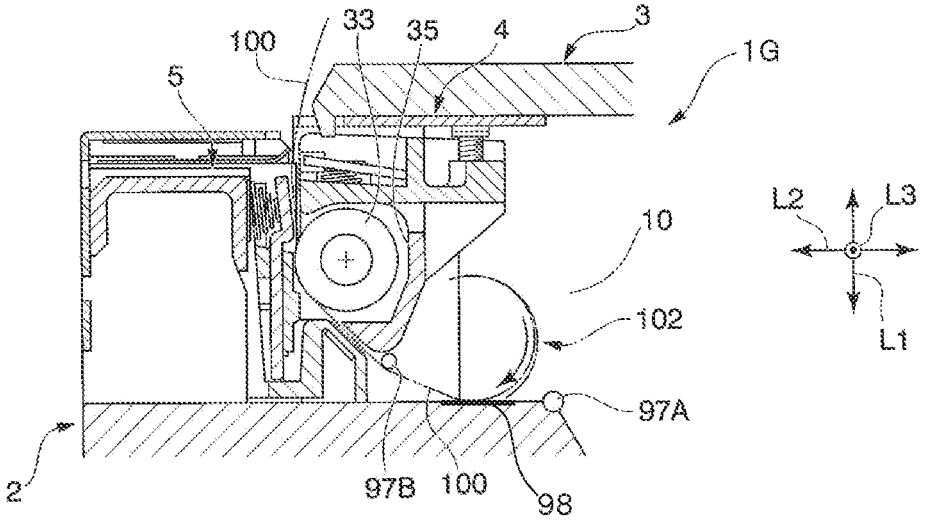
FIG. 16B is a view for schematically illustrating the thermal printer according to the eighth embodiment of the present invention, and is a partial cutaway view for illustrating a relationship of the pair of guide rolls with respect to the rolling start portion of the recording sheet formed into the turn-back shape.
Figure 16C:
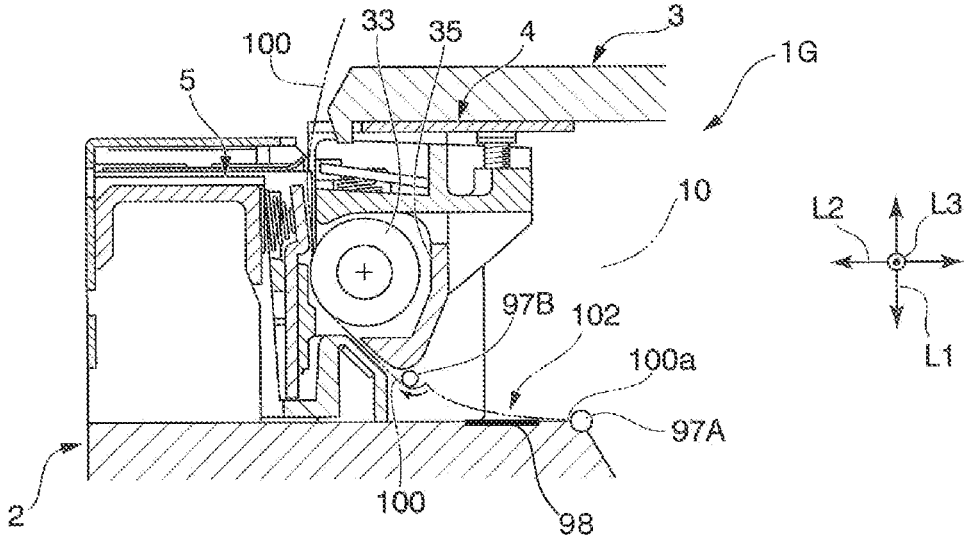
FIG. 16C is a view for schematically illustrating the thermal printer according to the eighth embodiment of the present invention, and is a partial cutaway view for illustrating a relationship of the pair of guide rolls with respect to the rolling start portion of the recording sheet formed into the turn-back shape.
Figure 17A:
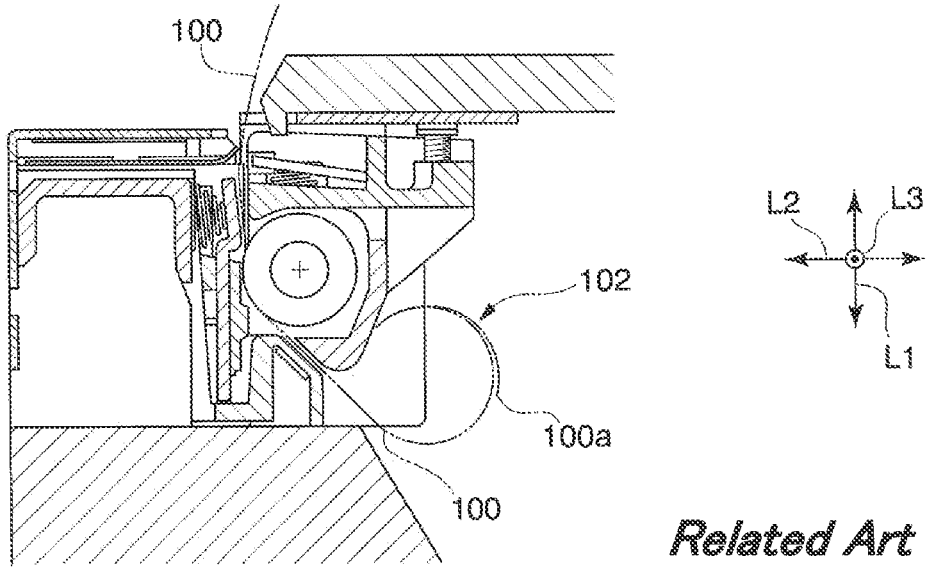
FIG. 17A is a partial cutaway view for schematically illustrating a related-art thermal printer.
Figure 17B:
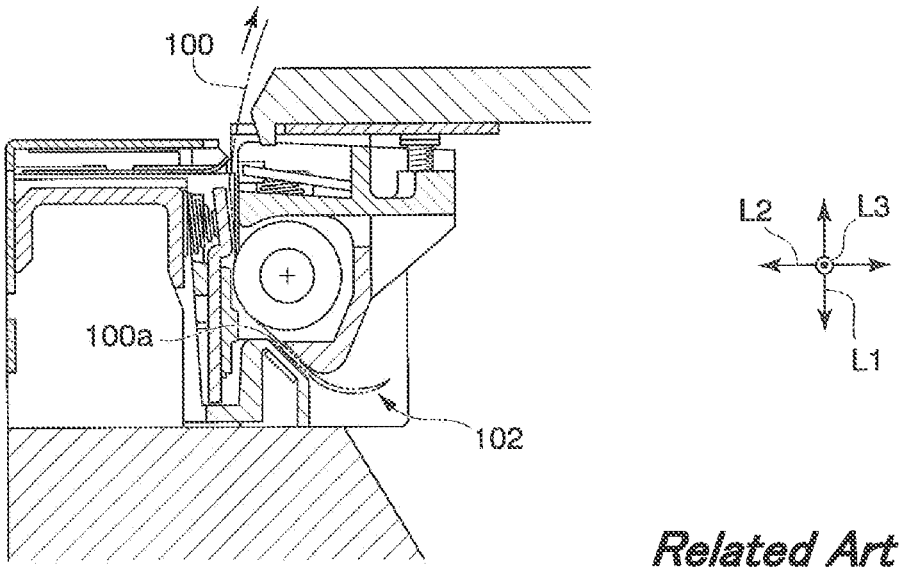
FIG. 17B is a partial cutaway view for schematically illustrating the related-art thermal printer.
Figure 17C:
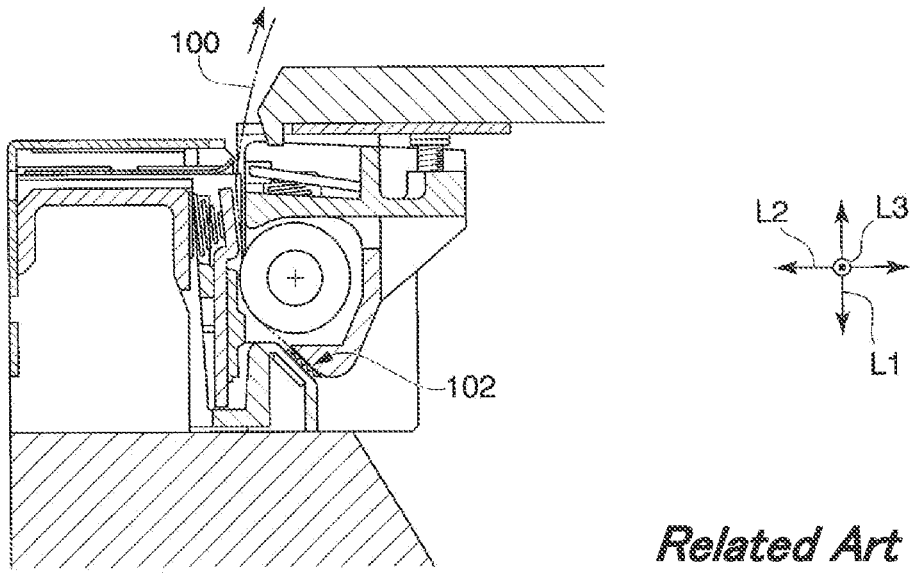
Related Art FIG.17C
FIG. 17C is a partial cutaway view for schematically illustrating the related-art thermal printer.

Now, a thermal printer 1G according to an eighth embodiment of the present invention is described mainly with reference to FIG. 16A, FIG. 16B, and FIG. 16C as appropriate. In the thermal printer 1G according to the eighth embodiment described below, components which are in common with the thermal printer 1, 1A, 1B, 1C, 1D, 1E, and 1F according to the first to seventh embodiments mentioned above are denoted by the same reference symbols in the drawings, and detailed description thereof is omitted in some cases.

FIG. 16A, FIG. 16B, and FIG. 16C are views for illustrating the thermal printer 1G according to the eighth embodiment, and are partial cutaway views for illustrating a relationship of a pair of guide rolls 97A and 97B with respect to the rolling start portion 102 of the recording sheet 100 formed into the turn-back shape. The thermal printer 1G according to this embodiment employs a configuration in which the separator is formed of the pair of guide rolls 97A and 97B. The pair of guide rolls 97A and 97B are provided such that, when the rolling start portion 102 of the recording sheet 100 is unrolled, the pair of guide rolls 97A and 97B pressurize the recording sheet 100 so as to allow at least a part of the recording sheet 100 to be brought into abutment against a frictional-resistance member 98.

Specifically, in the thermal printer 1G, as illustrated in FIG. 16A, FIG. 16B, and FIG. 16C, the guide roll 9A and the guide roll 97B are provided in the vicinity of the platen roller 33 in the platen unit 4 and are sequentially arranged from an upstream side of the recording sheet 100. The frictional-resistance member 98 is provided at a position more apart from the platen roller 33 than a line connecting the pair of guide rolls 97A and 97B. Further, in the example illustrated in, for example, FIG. 16A, the guide roll 97A provided on the upstream side and the guide roll 97B on a downstream side are arranged so as to be located apart in the vertical direction of FIG. 16A, FIG. 16B, and FIG. 16C with respect to the position of the roll sheet R. With this, the pair of guide rolls 97A and 97B are capable of pressurizing the recording sheet 100 such that at least a part of the recording sheet 100 is brought into abutment against the frictional-resistance member 98.

According to the thermal printer 1G of this embodiment, first, the recording sheet 100 unrolled from the roll sheet R (see, for example, FIG. 4A) is sequentially conveyed to the gap portion S between the head unit 5 and the platen unit 4 via the pair of guide rolls 97A and 97B. After thermal printing, the recording sheet 100 is cut as appropriate and conveyed to the outside. Then, when the remaining amount of the roll sheet R (recording sheet 100) becomes small, and the rolling start portion 102 rolled around the core body 101 (see, for example, FIG. 4A) is unrolled as illustrated in FIG. 16A, the recording sheet 100 which is unrolled from the core body 101 and is curled is brought into abutment in a pressurized state against the frictional-resistance member 98 by the stiffness of the recording sheet 100 and a guiding action of the guide roll 97B provided on the downstream side. With this, as illustrated in FIG. 16B, the recording sheet 100 on the frictional-resistance member 98 side at the rolling start portion 102 is caused to stay by the friction generated with the frictional-resistance member 98, and only another part of the recording sheet 100 at the rolling start portion 102 is pulled in the sheet-passage direction. Then, the rolling start portion 102 is opened by a relative action between parts of the recording sheet 100 folded on each other at the rolling start portion 102, and is conveyed to the gap portion S between the head unit 5 and the platen unit 4 while the parts of the recording sheet 100 are separated. That is, the recording sheet 100 is conveyed in a state without overlapping conveyance keeping the turn-back shape of the rolling start portion 102. Therefore, a paper jam or the like does not occur in the thermal printer 1G, and the last part of the recording sheet 100 is allowed to pass even at a timing immediately before the roll sheet R (recording sheet 100) runs out. Further, erroneous detection by the sheet run-out sensor can also be prevented.

As the pair of guide rolls 97A and 97B, similarly to the guide shaft 95 provided to the thermal printer 1A according to the second embodiment and the guide roller 85 provided to the thermal printer 1F according to the sixth embodiment mentioned above, there may be used a guide roller obtained by, for example, assembling a roller made of a rubber material or a resin material, such as an ABS resin or a PC resin, to a core shaft made of, for example, a stainless steel material.

Further, the frictional-resistance member 98 is also not particularly limited, and similarly to the frictional-resistance member 83 provided in the thermal printer 1 according to the first embodiment mentioned above, any material having a friction coefficient capable of achieving a high frictional force with respect to the recording sheet 100, for example, a polyurethane foam or various rubber materials can be suitably employed.

As described above, according to the thermal printers 1, 1A, 1B, 1C, 1D, 1E, 1F, and 1G of the first to eighth embodiments, with the respective configurations described above, the parts of the recording sheet 100 folded on each other at the rolling start portion 102 which is rolled around the core body 101 and has the turn-back shape in the recording sheet 100 rolled into the roll shape around the core body 101 are effectively separated. Accordingly, conveyance of the rolling start portion 102 to the gap portion S between the head unit 5 and the platen unit 4 while keeping the turn-back shape can be prevented. Therefore, at the timing of the sheet run-out of the recording sheet 100 having the roll shape, the paper jam or the like does not occur inside the printer, and erroneous detection by the sensor can also be prevented. Thus, a thermal printer which is conspicuously excellent in reliability can be provided.

What is claimed is:

1. A thermal printer, comprising:

a head unit including a thermal head configured to perform printing on a recording sheet;

a platen unit, which includes a platen roller configured to convey the recording sheet, and is separably combined with the head unit;

a printer main body, which has a recording-sheet receiving portion configured to receive the recording sheet, and has the head unit mounted thereto;

a printer cover, which has the platen unit mounted thereto, and is coupled to the printer main body so as to be pivotable; and a separator, which is provided in the recording-sheet receiving portion, and is configured to separate parts of the recording sheet, which is rolled into a roll shape around a core body, folded on each other at a rolling start portion, which is rolled around the core body and has a turn-back shape.

2. The thermal printer according to claim 1, wherein the separator includes a first separation wall which is provided at a position at which, when the rolling start portion of the recording sheet is unrolled, at least a part of a peripheral surface of the rolling start portion is brought into abutment along with a repulsive force generated by the stiffness of the recording sheet.

3. The thermal printer according to claim 2, wherein the first separation wall is provided so as to pressurize at least a part of the peripheral surface of the rolling start portion of the recording sheet.

4. The thermal printer according to claim 2, wherein the first separation wall includes a frictional-resistance member at a position at which at least a part of a peripheral surface of the rolling start portion of the recording sheet is brought into abutment.

5. The thermal printer according to claim 2, wherein the first separation wall includes a locking portion configured to lock an end portion formed into a turn-back shape at the rolling start portion at a position at which at least a part of a peripheral surface of the rolling start portion of the recording sheet is brought into abutment.

6. The thermal printer according to claim 2, wherein the separator further includes a second separation wall which is provided at a position of being opposed to the first separation wall across the unrolled recording sheet and at which at least a part of the peripheral surface of the rolling start portion is brought into abutment along with a repulsive force generated by the stiffness of the recording sheet when the rolling start portion of the recording sheet is unrolled.

7. The thermal printer according to claim 2, wherein the separator further includes a tension bar, which is located at a position of being opposed to the first separation wall across the unrolled recording sheet, and is configured to guide the recording sheet toward the first separation wall side.

8. The thermal printer according to claim 1, wherein the separator includes:

a tension bar, which is provided at a position of being opposed to the platen unit across the unrolled recording sheet, and is configured to guide the recording sheet toward the platen unit side;

a guide portion, which is provided so as to be opposed to the tension bar at a position in the vicinity of an inlet of a gap portion to which the recording sheet is conveyed in the platen unit, and against which the recording sheet guided toward the platen unit side by the tension bar is brought into abutment; and a third separation wall, which is provided on a side opposite to the guide portion across the guide portion in the vicinity of an inlet of the gap portion, and against which at least a part of the recording sheet guided by the tension bar and the guide portion is brought into abutment, wherein a distal end of the tension bar and a distal end of the guide portion are arranged so as to overlap each other in a direction in which the platen unit and the tension bar are opposed to each other.

9. The thermal printer according to claim 1, wherein the separator includes:

a tension bar configured to guide the recording sheet toward the platen unit side at a position of being opposed to the platen unit across the unrolled recording sheet;

a fourth separation wall, which is arranged between the platen unit and the tension bar, and is configured to guide the recording sheet between the fourth separation wall and the tension bar; and a third separation wall, which is provided in the vicinity of an inlet of the gap portion, and against which at least a part of the recording sheet guided by the tension bar and the fourth separation wall is brought into abutment.

10. The thermal printer according to claim 1, wherein the separator is formed of a pair of guide rolls which are provided so as to pressurize the recording sheet so that at least a part of the recording sheet is brought into abutment against a frictional-resistance member when the rolling start portion of the recording sheet is unrolled.

* * * * *